FIP7811 XR 4,118,071

United States Patent [19]

Hutchins

[11] 4,118,071

[45] Oct. 3, 1978

[54] IN SITU OIL SHALE RETORT WITH A HORIZONTAL SILL PILLAR

[75] Inventor: Ned M. Hutchins, Grand Junction, Colo.

[73] Assignee: Occidental Oil Shale, Inc., Grand Junction, Colo.

[21] Appl. No.: 790,350

[22] Filed: Apr. 25, 1977

[51] Int. Cl.[2] ..... E21B 43/24; E21C 41/10

[52] U.S. Cl. ..... 299/2; 166/259; 299/13; 102/23

[58] Field of Search ..... 299/2, 13, 15, 4, 5; 166/256, 259, 271, 247, 299; 102/23, 21

[56] References Cited

U.S. PATENT DOCUMENTS

| | | | |
|---|---|---|---|
| 1,913,395 | 6/1933 | Karrick | 299/2 |
| 1,919,636 | 7/1933 | Karrick | 299/2 |
| 2,481,051 | 9/1949 | Uren | 299/2 |
| 3,001,776 | 9/1961 | van Poollen | 299/2 |
| 3,466,094 | 9/1969 | Haworth et al. | 299/13 |
| 3,537,753 | 11/1970 | Arendt | 299/2 |
| 4,022,511 | 5/1977 | French | 299/2 |
| 4,043,595 | 8/1977 | French | 299/2 |
| 4,043,596 | 8/1977 | Ridley | 299/2 |
| 4,043,597 | 8/1977 | French | 299/2 |
| 4,043,598 | 8/1977 | French et al. | 299/2 |

OTHER PUBLICATIONS

Anonymous, Article in "SYNTHETIC FUELS", Cameron Engineers, Inc., Jun., 1975, pp. 2–21 to 2–24.

*Primary Examiner*—Stephen J. Novosad
*Attorney, Agent, or Firm*—Christie, Parker & Hale

[57] ABSTRACT

An in situ oil shale retort is formed in a subterranean formation containing oil shale. The retort with top, bottom and side boundaries contains a fragmented permeable mass of particles containing oil shale. A base of operation is excavated at a working level in the formation. Means are excavated through the formation for access to a location underlying the base of operation. In one embodiment, a void in the form of a vertical slot is excavated in the site between the means for access and an elevation below the bottom of the base of operation, leaving a remaining portion which is to be expanded toward the void. This is designed to leave a horizontal sill pillar of intact formation between the top of the void and the bottom of the base of operation with a vertical thickness sufficient to maintain a safe base of operation after explosive expansion of formation to form the fragmented permeable mass of particles. The void provides at least one free face extending vertically through the formation within the boundaries of the in situ oil shale retort site. This remaining portion is explosively expanded toward the void with a single round of explosions.

38 Claims, 9 Drawing Figures

IN SITU OIL SHALE RETORT WITH A HORIZONTAL SILL PILLAR

CROSS-REFERENCE TO RELATED APPLICATIONS

This application is related to U.S. Patent applications Ser. No. 659,899 entitled "MULTIPLE ZONE PREPARATION OF OIL SHALE RETORT" filed Feb. 20, 1976, by Gordon B. French and Donald E. Garrett, now U.S. Pat. No. 4,043,598; Ser. No. 658,699 entitled "MULTIPLE LEVEL PREPARATION OF OIL SHALE RETORT" filed Feb. 17, 1976, by Gordon B. French, now U.S. Pat. No. 4,043,597; Ser. No. 603,704 entitled "IN SITU RECOVERY OF SHALE OIL", filed Aug. 11, 1975, by Gordon B. French now U.S. Pat. No. 4,043,595; Ser. No. 603,705, entitled "IN SITU RECOVERY OF SHALE OIL" filed Aug. 11, 1975, by Richard D. Ridley, now U.S. Pat. No. 4,043,596; Ser. No. 505,363 entitled "METHOD FOR IN SITU RECOVERY OF CONSTITUENTS FROM ORE DEPOSITS" filed Sept. 12, 1974, by Gordon B. French, now abandoned; and to Ser. No. 716,583 entitled "METHOD FOR IN SITU RECOVERY OF LIQUID AND GASEOUS PRODUCTS FROM OIL SHALE DEPOSITS" filed Aug. 23, 1976, by Gordon B. French, now abandoned. These applications are assigned to the same assignee as the present application and the contents thereof are incorporated herein by reference.

The above mentioned applications are relevant to the present application since each described techniques for forming an in situ oil shale retort containing a fragmented permeable mass of particles containing oil shale. An underground room having a horizontal extent similar to the horizontal cross section of the fragmented mass is employed for at least some excavation or explosive expansion operations. In application Ser. No. 603,704, now U.S. Pat. No. 4,043,595, a horizontal pillar of intact formation is left between the top of a columnar void and the bottom of an overlying work area during formation of the retort.

BACKGROUND

This application relates to the recovery of liquid and gaseous products from oil shale. The term "oil shale" as used in the industry is in fact a misnomer; it is neither shale nor does it contain oil. It is a sedimentary formation comprising marlstone deposit with layers containing an organic polymer called "kerogen", which upon heating decomposes to produce carbonaceous liquid and gaseous products. It is the formation containing kerogen that is called "oil shale" herein and the carbonaceous liquid product is called "shale oil".

One technique for recovering shale oil is to form an in situ oil shale retort in a subterranean formation containing oil shale. At least a portion of the formation within the boundaries of the in situ oil shale retort being formed is explosively expanded to form a fragmented permeable mass of particles containing oil shale.

The fragmented mass is ignited near the top to establish a combustion zone. An oxygen containing gas is introduced in the top of the retort to sustain the combustion zone and cause it to advance downwardly through the fragmented permeable mass of particles in the retort. As burning proceeds the heat of combustion is transferred to the fragmented permeable mass of particles containing oil shale below the combustion zone to release shale oil and gaseous products therefrom in a retorting zone. Thus, a retorting zone advances from top to bottom of the retort in advance of the combustion zone and the resulting shale oil and gaseous products pass to the bottom of the retort for collection and removal.

In preparation for the retorting process it is important that the formation containing oil shale be fragmented rather than simply fractured to create sufficient permeability that undue pressures are not required to pass the gases through the retort. The aforementioned patent applications provide techniques for fragmenting a substantial volume of formation containing oil shale to form a fragmented permeable mass in an in situ oil shale retort. In these applications an in situ oil shale retort is formed in a subterranean formation containing oil shale by excavating a void having a vertically extending free face, drilling blasting holes adjacent to the columnar void and parallel to the free face, loading explosive into the blasting holes, and detonating the explosive to expand the formation adjacent the columnar void toward the free face. In one embodiment the void is cylindrical and blasting holes are arranged in concentric rings around the void. In another embodiment the void is a slot having one or more large parallel planar vertical free faces toward which the formation in the retort volume is explosively expanded. In such an embodiment the blasting holes are preferably arranged parallel to the free faces. For larger retorts a plurality of voids can be excavated and the formation expanded toward the respective voids to form a continuous fragmented permeable mass of particles containing oil shale.

In applications Ser. Nos. 659,899 and 658,699, a plurality of vertically spaced apart voids providing horizontally extending free faces are excavated in the retort site and remaining formation in the retort site is explosively expanded toward such voids for forming a fragmented permeable mass.

In embodiments disclosed in application Ser. No. 603,704 a base of operation is excavated in formation at the site of an in situ retort to be formed. An access tunnel is excavated to a location below the base of operation. A columnar void is excavated in communication with the lower tunnel. The top of the columnar void is spaced from the bottom of the base of operation at the top to leave a horizontal pillar of intact formation between the top of the columnar void and the bottom of the base of operation. This leaves the floor of the base of operation free from a hazardous condition, namely, a large opening during operations conducted therefrom. The debris or muck created during formation of the columnar void can be drawn from the lower tunnel for removal.

It has been found that it can be desirable to have an intact subterranean base of operation above a fragmented permeable mass of particles in an in situ oil shale retort. Such a base of operation facilitates ignition over the top portion of the fragmented mass, permits control of introduction of oxygen containing gas into the retort, provides a location for testing properties of the fragmented mass such as distribution of void fraction and for evaluating performance of the retort during operation, and aids in controlling flow of ground water which might otherwise enter the fragmented mass during retorting.

BRIEF SUMMARY OF THE INVENTION

There is, therefore, provided in practice of this invention according to presently preferred embodiments a technique of forming, in a subterranean formation, an in situ oil shale retort containing a fragmented permeable mass of particles containing oil shale. A portion of the formation is excavated to form a base of operation at an upper or working level in the formation at the retort site. Means for access are formed at a lower or production level to a location underlying the base of operation.

In one embodiment a portion of the formation is excavated to form at least one vertically extending void having a free face extending vertically through the formation within the boundaries of the fragmented mass being formed. This leaves a remaining portion of the formation which is to be fragmented by expansion toward the void within the boundaries and extending away from such a free face. The void extends vertically between the means of access and an elevation spaced below the bottom of the base of operation, thereby leaving a horizontal sill pillar of intact formation between the top of the void and the bottom of the base of operation. The horizontal sill pillar has a vertical thickness sufficient to maintain a safe base of operation above the sill pillar after explosive expansion of the remaining portion of the formation within the boundaries toward the void. This remaining portion of formation is explosively expanded toward the void with a single round of explosions for forming the fragmented permeable mass of particles. Configuration of the group of excavations comprising the underlying drift means for access, the vertically extending void and the overlying base of operation above the horizontal sill pillar comprise another aspect of this invention. The base of operation can be an array of elongated galleries and rib pillars, a work room, or other means for effectively providing access over substantially the entire horizontal cross section of the fragmented mass.

DRAWINGS

These and other features and advantages of the present invention will be appreciated as the same becomes better understood by reference to the following detailed description of presently preferred embodiments when considered in connection with the accompanying drawings wherein.

DESCRIPTION

General Discussion

Figure 1:
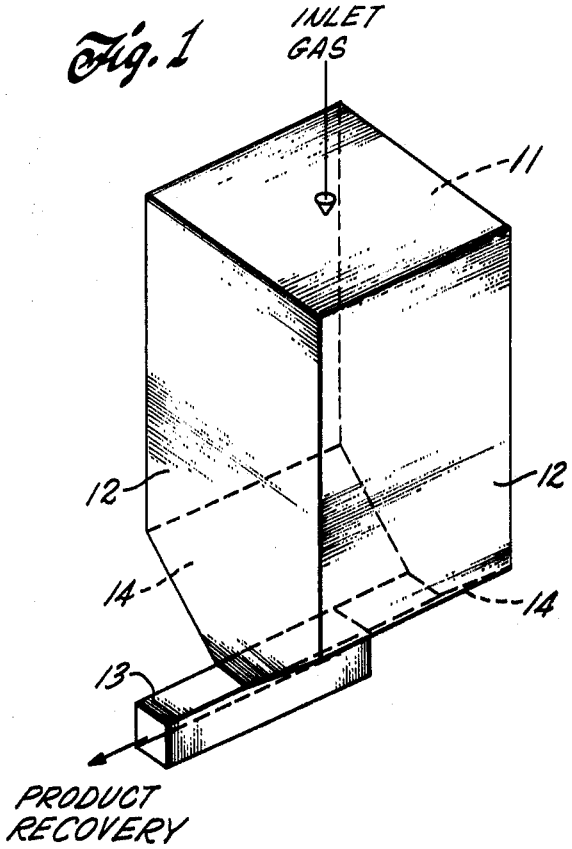
FIG. 1 illustrates schematically the general shape of one embodiment of in situ oil shale retort constructed in accordance with principles of this invention.

An in situ oil shale retort containing a fragmented permeable mass of particles being formed according to methods of this invention has a base of operation formed on a working level in a subterranean formation. This working level is at an upper elevation above the top of such a fragmented mass being formed. A fragmented permeable mass of particles containing oil shale is formed below the base of operation by explosive expansion of formation toward an excavated void. The bottom of the base of operation is separated from the top boundary of the fragmented mass by a horizontal sill pillar of unfragmented formation. The horizontal sill pillar is sufficiently thick that it withstands stresses imposed by explosive expansion, as well as geologic stresses, to provide a safe base of operation after formation of the fragmented mass. This permits men and equipment to enter the base of operation over the top of the fragmented mass after explosive expansion. The base of operation on the working level can have a horizontal extent that permits effective access over substantially the entire horizontal cross section of the fragmented mass, which is of great assistance in forming or operating an in situ retort.

A horizontal sill pillar of unfragmented formation between the working level and the top boundary of the fragmented mass providing a safe base of operation over the retort can serve many useful purposes. During formation of the retort the base of operation provides a location from which at least a portion of the excavation and explosive expansion operations can be conducted. After explosive expansion the base of operation provides access for distribution of oxygen containing gas introduced into the fragmented mass through the sill pillar. The base of operation is convenient for igniting an upper portion of the fragmented mass and assuring a uniform combustion zone in the fragmented mass. The base of operation provides a location for measurement and control of the combustion and retorting processes occurring in the fragmented mass below the sill pillar.

Water which can enter the working level from formation above the base of operation can be diverted through the working level to locations removed from the retort site. It is believed that the retorting of oil shale changes the solubility of constituents of the oil shale so that water passing through retorted oil shale would dissolve such constituents. Nahcolite, dawsonite, and possibly some residual organic materials in retorted oil shale, are examples of such constituents. Water entering an in situ retort after completion of retorting and dissolving such constituents could require purification prior to discharging such water into streams or underground aquifers. The base of operation above the horizontal sill pillar can avoid such problems.

It can be desirable in some circumstances to enlarge the size of a fragmented mass of particles to be retorted in an in situ oil shale retort by explosive expansion of a horizontal sill pillar toward a base of operation above the sill pillar. If this is done oxygen containing gas can be introduced to the in situ oil shale retort by way of an air level excavation at an elevation above the top of the resultant fragmented mass.

For purposes of this application, the designation of a "working level" indicates the general elevation in the subterranean formation at which underground workings or galleries are excavated and utilized in the formation of a fragmented mass below a horizontal sill pillar in a retort being formed. Underground workings includes excavations of any desired configuration, such as drifts, adits, tunnels, crosscuts, rooms or the like. The base of operation on the working level indicates the location on the working level below which a fragmented mass below a horizontal sill pillar is to be formed. It can also include the location of equipment employed during retorting of the fragmented mass below the sill pillar.

As described in greater detail hereinafter, in one method of forming an in situ oil shale retort in a subterranean formation containing oil shale, a portion of the formation is excavated to form a base of operation on an upper working level. A drift or similar means of access is excavated through formation at a lower level to a location underlying the base of operation. Such lower level is identified herein as a "production level" which designates underground workings at an elevation in the formation at or below the bottom of such in situ retorts.

In preparing such a retort, at least one void is excavated from within the boundaries of the fragmented mass being formed, the void being connected to the access drift on the production level underlying the base of operation. This leaves another portion of the formation within the boundaries of the retort being formed which is to be fragmented by explosive expansion toward such void. The void is excavated only to an elevation above the access drift that leaves a horizontal sill pillar of intact formation between the top of the void and the bottom of the base of operation. The surface of the formation defining the void provides at least one free face which extends through the formation and the remaining portion of the formation within the boundaries of the retort being formed is explosively expanded towards such a free face. The vertical thickness of the horizontal sill pillar is sufficient to maintain a safe base of operation over the fragmented mass after such explosive expansion.

In such a method where the void extends vertically within the boundaries of the fragmented mass being formed, the surface of the formation defining the void provides at least one vertically extending free face. The portion of the formation to be expanded toward such a void extends horizontally away from the free face.

Other techniques can be employed for forming a fragmented mass below a horizontal sill pillar. Thus, for example, a formation can be excavated within the boundaries of the retort site to form a plurality of horizontally extending voids. The surface of formation defining such a void provides a free face extending horizontally through the formation within the boundaries of the fragmented mass being formed. Formation that is to be expanded toward such a void extends vertically away from such a free face. In such an embodiment the upper boundary of the fragmented mass is at an elevation below the bottom of the base of operation and separated therefrom by a horizontal sill pillar of unfragmented formation.

In a preferred embodiment, the horizontal extent of the base of operation over the fragmented mass in an in situ retort is sufficient to provide effective access to substantially the entire horizontal cross section of the fragmented mass. This does not require that there be an open excavation over the entire horizontal extent of the fragmented mass, but roof supporting pillars can be left on the working level in a portion of the area directly above the fragmented mass. The size and arrangement of such working level pillars leaves an open base of operation having a sufficient horizontal extent for access to substantially the entire horizontal cross section of the retort site for excavation operations for forming a void, for drilling and explosive loading, for explosive expansion of formation toward such a void, and in a preferred embodiment, for uniform distribution of oxygen containing gas introduced into the top of the fragmented mass below the horizontal sill pillar.

In a preferred embodiment, a plurality of vertically extending blasting holes are drilled through the sill pillar into formation remaining below the sill pillar. Explosive is loaded into such blasting holes from the base of operation up to a level about the same as the bottom of the horizontal sill pillar, which is to remain unfragmented. Such explosive is detonated for explosively expanding subterranean formation toward such void below the sill pillar.

Dimensions of the underground workings at the base of operation on the working level of the roof supporting pillars which remain on the working level, and of the horizontal sill pillar between the base of operation and the fragmented mass can be determined by application of known techniques for rock failure analysis. Such analysis can include consideration of strength of formation forming the roof supporting and horizontal sill pillars, the geologic stresses imposed on such pillars and the stresses induced therein by detonating explosive to form the fragmented permeable mass. Bending and shearing stresses, compressive loads, and stresses which could tend to cause spalling into the base of operation can be considered.

DETAILED DESCRIPTION

In one embodiment this invention concerns techniques for forming an in situ oil shale retort which has a shape such as that illustrated schematically in FIG. 1. As illustrated in this drawing the in situ oil shale retort appears as a solid body, however, it will be recognized that this is a simplification for purposes of illustration. An in situ oil shale retort comprises a fragmented permeable mass of particles containing oil shale in a subterranean formation containing oil shale. FIG. 1 illustrates the boundaries of such a fragmented permeable mass of particles to show one exemplary configuration.

As illustrated in FIG. 1 the fragmented permeable mass of particles has an upper boundary 11 and four side boundaries 12. As illustrated in FIG. 1 the upper boundary 11 is substantially flat, however, it will be apparent that if desired it can have any desired shape, such as a somewhat domed configuration. The side boundaries 12 of the in situ oil shale retort define a generally square or rectangular horizontal cross section.

A drift 13 at a production level provides a means for access to a lower boundary of the in situ oil shale retort. The lower boundary in this embodiment is in the form of a pair of faces or walls 14 sloping at an angle of about 45° toward the back or roof of the drift 13. The volume defined by the upper boundary 11, lower boundary 14 and side boundary 12 contains a fragmented permeable mass of particles containing oil shale. This fragmented permeable mass also fills the portion of the drift 13 extending beneath the volume so defined. Some of the fragmented permeable mass can also be present in the drift 13 at the end near the in situ oil shale retort.

During operation of the retort, an inlet gas used in processing for retorting of the oil shale is passed downwardly through the fragmented mass. Gas is introduced to an upper portion of the fragmented permeable mass. The drift 13 provides a means for collecting and recovering liquid products and withdrawing an off gas containing gaseous products from retorting oil shale in the in situ oil shale retort. A variety of retorting techniques can be employed, some of which are set forth in the prior art, and since this invention concerns forming the in situ oil shale retort no further description of them is needed for one skilled in the art.

A method of forming an in situ oil shale retort such as illustrated in FIG. 1 involves excavating a portion of the formation to form a base of operation on a working level at least partly overlying the drift 13 at the lower, production level. A vertically extending void is excavated above the lower drift using the working level base of operation as a location to conduct part of the excavation operations. The material excavated from the void is withdrawn by way of the access drift 13 and other underground workings (not shown) on the production level. Formation containing oil shale is then explosively expanded toward the void to form the fragmented permeable mass of particles.

Figure 2:
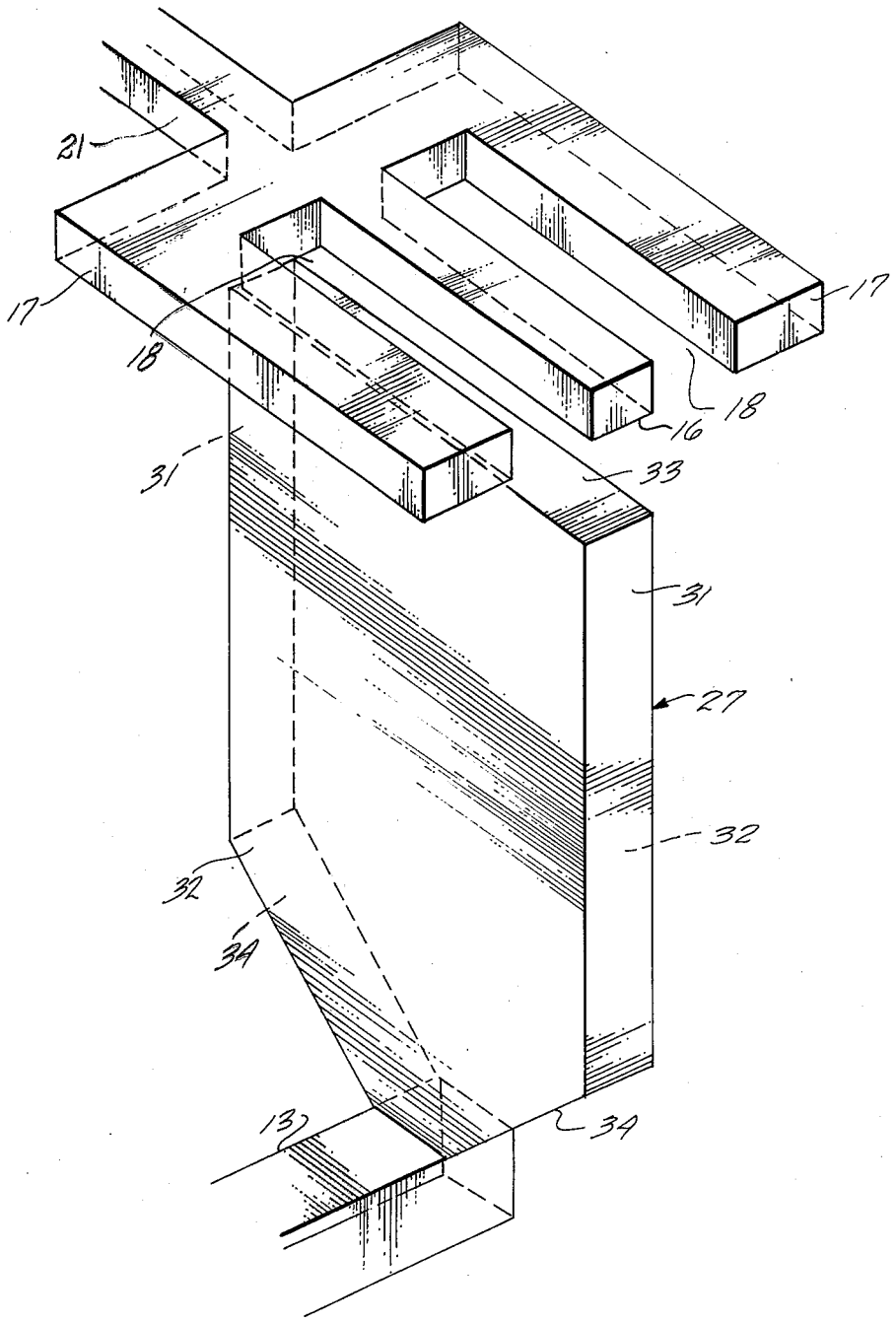
FIG. 2 is a schematic perspective illustration of excavations at an intermediate stage in forming an in situ oil shale retort.
Figure 3:
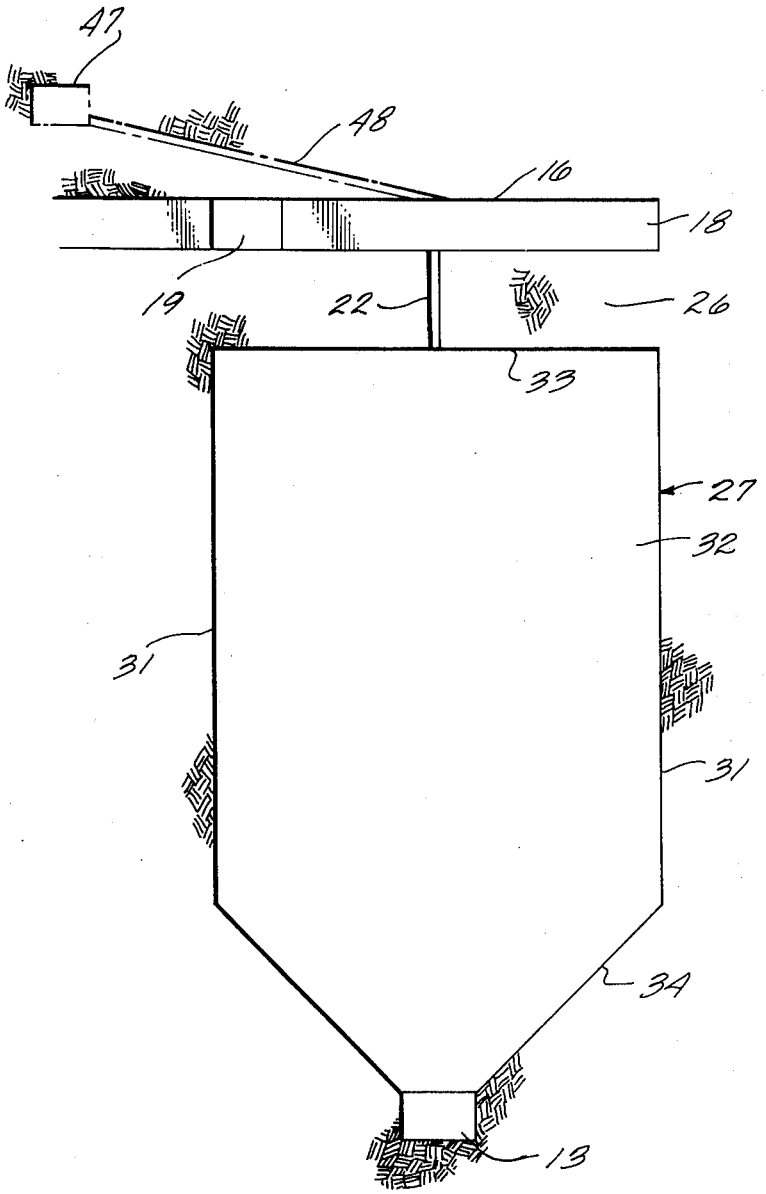
FIG. 3 is a vertical cross section through the middle of an in situ oil shale retort at the intermediate stage of construction illustrated in FIG. 2.
Figure 4:
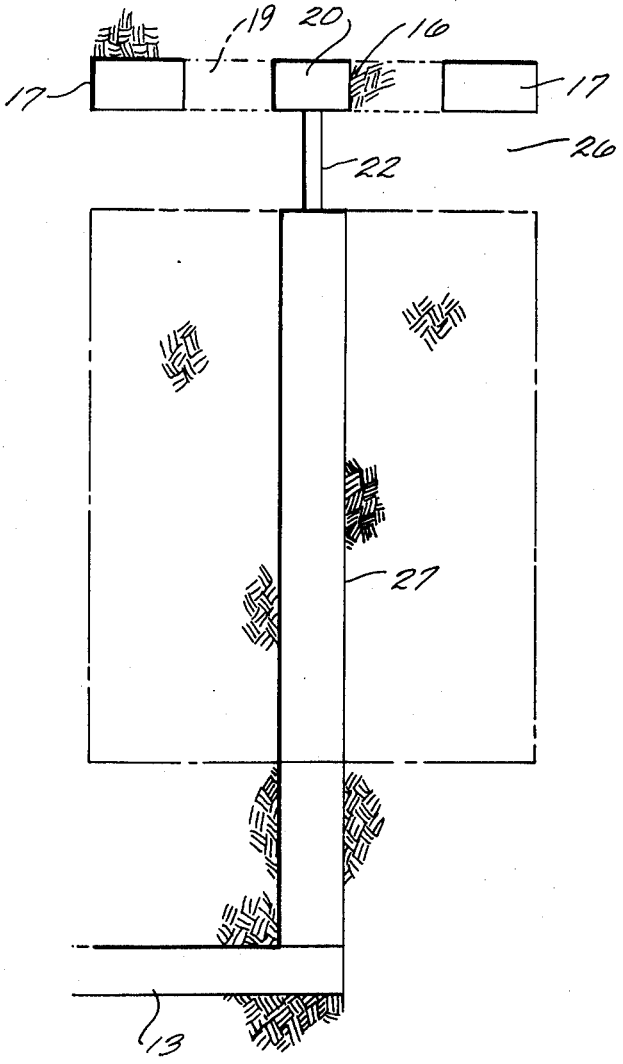
FIG. 4 is another vertical cross section through the middle of the in situ oil shale retort normal to the cross section of FIG. 3.
Figure 5:
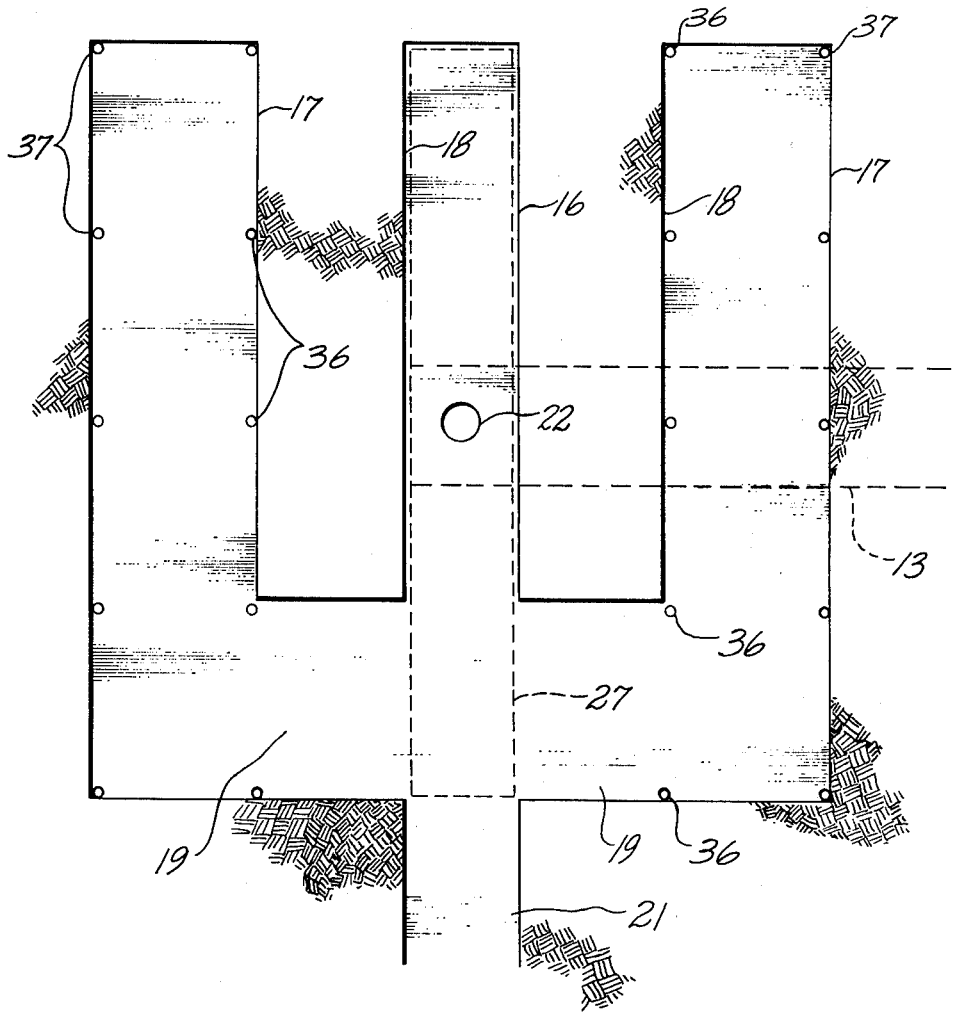
FIG. 5 is a horizontal cross section at the level of a base of operation at the intermediate stage of forming the in situ oil shale retort.

FIGS. 2 to 5 illustrate an in situ oil shale retort being formed at an intermediate stage in its preparation. FIG. 2 is a schematic perspective illustration of a group of underground workings during this intermediate development of the retort. It is drawn as if the solid rock were transparent and the excavations formed therein were solid objects. Thus, the near surfaces of the excavated spaces are shown solid and shaded and the far portions are shown as hidden lines. FIGS. 3 and 4 are vertical cross sections through the middle of the retort site during preparation of the retort and FIG. 5 is a horizontal cross section at the working level. In the drawings the boundaries of the various excavations are indicated with straight lines. It will be recognized that some roughness of these surfaces will occur as is normal in blasting rock. The following description of an exemplary embodiment of this invention is made with reference to these figures.

In the illustrated embodiment the drift 13 on the production level, which provides a means for access to the lower portion of the excavation, is extended to about the middle of the horizontal cross section of the in situ retort site.

At about the same time as the lower drift 13 is driven to the center of the retort site, a base of operation is excavated on the working level overlying the end of the lower level drift 13. In one working embodiment the top of the drift 13 is about 250 feet below the sill or floor of the base of operation. The drift has a width of about 16 to 25 feet and a height of about 12 to 14 feet. In the illustrated embodiment, the base of operation has a central drift 16 and a side drift 17 on each side thereof. The two side drifts are similar to each other. Elongated roof supporting pillars 18 of intact formation separate the side drifts 17 from the central drift 16. Short crosscuts 19 interconnect the side drifts 17 and central drift 16 to form a generally E-shaped excavation. Other arrays of drifts and roof supporting pillars are disclosed hereinafter. A branch drift 21 provides access to the base of operation from underground mining development workings (not shown) at the level of the base of operation.

In a working embodiment the branch drift 21 leading to the base of operation is about 20 feet wide, and it and the drifts at the base of operation at the top of the retort site are about 14 to 16 feet high. The central drift 16 is about 25 feet wide and the side drifts are about 30 feet wide. Each of the side drifts 17 is about 125 to 130 feet long. The central drift is about 120 feet long. These three drifts on the working level are interconnected by crosscuts 19 that are about 30 feet wide. The pillars 18 of unfragmented formation left between the drifts in the E-shaped base of operation are about 20 to 25 feet wide and about 85 feet long.

The central drift 16 of the base of operation is excavated first, followed by the side drifts 17. To some extent these operations proceed simultaneously for best mining efficiency and variations of the procedure are well within the skill of the art. Initial excavation of the central drift is desirable since it serves as a base of operation for part of the excavation operations during formation of the void and the side drifts serve as a base of operation for preparation of explosive expansion, which occurs thereafter.

When suitable access has been made available in the central drift 16 a ten inch diameter bore hole is drilled downwardly from the base of operation to the lower level access tunnel 13 at about the center of the lower boundary of the retort site. A conventional four foot diameter raise boring bit is then attached to the drill string extending through the bore hole from the base of operation to the lower production level. A circular raise 22 is bored from the lower drift 13 to the central drift 16. During raise boring, fragments of the formation fall to the lower access drift 13 for removal.

Suitable raise boring bits from about 4 to 12 feet in diameter are commercially available for forming such raises. Suitable apparatus and techniques for forming such a raise are provided in U.S. Patent application Ser. No. 663,547 entitled "Raise Bore Drilling" filed Mar. 3, 1976, by Gordon B. French and assigned to the same assignee as the present application.

In the illustrations of FIGS. 2 to 5 subsequent excavations have removed the walls of the initial bored raise over most of its length (or height) to form a slot 27. Only the top portion of this original bored raise near the upper level base of operation remains in these views. This portion is indicated by the reference numeral 22 in the drawings.

Figure 6:
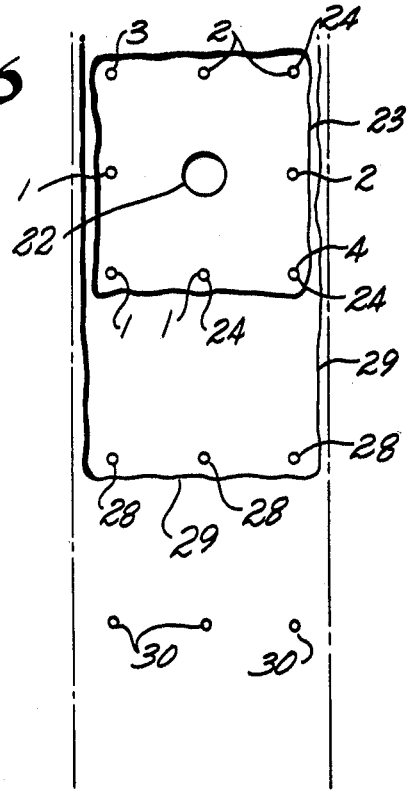
FIG. 6 illustrates semi-schematically a suitable blasting pattern for excavating a slot during formation of an in situ oil shale retort.

After the initial raise 22 is bored, it is enlarged by blasting. Drilling operations for enlarging the raise are conducted from the working level base of operation and particles of formation from enlargement of the raise are excavated from the production level access drift 13. FIG. 6 provides a schematic illustration for explanation of part of the technique used for enlarging the bored raise to form a slot. As illustrated therein, the raise 22 is enlarged to approximately a square raise 23 illustrated by solid lines in FIG. 6.

The desired slot is indicated by phantom lines and freehand lines are used to indicate the free faces of formation actually formed as walls of the slot. This is appropriate since the formation does not ordinarily break to form smooth walls due to blasting alone. The walls are also indicated as somewhat farther apart than the blasting holes used in forming the slot. This often corresponds to the actual occurrence in mining due to overbreaking of the formation near the blasting holes.

Blasting holes or shot holes 24 are drilled downwardly from the central drift 16 of the base of operation approximately parallel to the bored raise 22. These blasting holes are illustrated somewhat larger than actual scale in FIG. 6 for clarity. In a working example, 3-⅝ inch diameter drill holes are used for enlarging a raise from an initial 4 foot diameter bore hole to a square raise about 15 to 18 feet on a side. The outer blasting holes are about 13 feet apart in such an embodiment.

Three of the blasting holes 24 in FIG. 6 are labelled with a numeral 1. To enlarge the circular raise 22 the bottom 24 feet of each of these blasting holes near the drift 13 is loaded with explosive and detonated. All three holes 1 are loaded with explosive and shot in a single round with different time delays between detonations in each hole. One of the side holes has no delay, the other side hole has about 50 milliseconds delay, and the corner hole has about 100 milliseconds delay. A mixture of ammonium nitrate and fuel oil (ANFO) makes a suitable inexpensive explosive for the blasting described herein. A variety of explosive TNT slurries, dynamite compositions and the like are also available.

This fragments the formation between the blasting holes and the bored raise 22 and the resulting rubble is excavated from the lower level access drift 13. Additional portions of the length of the blasting holes 1 are loaded with explosives in increments gradually increasing in length to about 40 feet. Each increment is detonated and the resulting rubble excavated from the bottom of the raise before the next increment is shot. A total of six such increments in the blasting holes 1 extends the enlarged raise about 210 feet above the lower tunnel 13. As described in greater detail hereinafter, unfragmented formation is left between the top of the enlarged raise and the bottom of the base of operation. Breakage into overlying formation is inhibited by stemming explosive in the blasting holes with sand or the like as the raise is being enlarged.

After the initial enlargement of the raise by shooting the blasting holes 1 in increments, explosive is loaded into the blasting holes labelled 2 in FIG. 6 and detonated to fragment formation between these blasting holes and the enlarged raise. These blasting holes 2 are also shot in increments of height and somewhat longer increments can be used than for the initial enlargement of the raise without significant problems of plugging the raise with rubble. Thus, for example, three increments can be sufficient for this group of blasting holes, whereas six increments are used in the initial enlargement.

Thereafter, the blasting hole labelled 3 in FIG. 6 is loaded with explosive and blasted for further enlarging the raise and "squaring up the corner". Since this involves fragmentation of a limited portion of formation and the raise is already of a substantial size, the full desired height of the raise can be enlarged in a single increment. Finally, the blasting hole identified as 4 in FIG. 6 is loaded and detonated in the same manner as blasting hole 3 to complete the raise. As before, the rubble produced from shooting holes 3 and 4 is removed through the production level access drift 13.

Although in the enlargement hereinabove described eight symmetrically located blasting holes are used for enlarging the raise, it will be apparent that other arrangements of blasting holes can be used as required. Thus, for example, if the burden between some of the blasting holes and the raise is too large to assure complete fragmentation and easy drawing of the resultant rubble from the bottom of the raise, additional blasting holes can be used between those on the periphery of the desired raise and the bored raise. Thus, for example, one or two additional blasting holes (not shown) can be employed between the bored raise and the blasting holes labelled 1 in FIG. 6 to provide an initial enlargement of the bored raise. Such can be required in actual mining operations since drilling a truly vertical hole is not always accomplished and measured deviations may indicate an unduly thick burden between part of a blasting hole and the nearest free face. For example, in a working example it was decided that a greater burden than desired was present between a partially enlarged raise and the group of blasting holes corresponding to those labelled 2 in FIG. 6. Two additional, substantially vertical, blasting holes were therefore drilled through this burden and shot in three increments to enlarge the raise in an additional segment before those holes corresponding to the blasting holes labelled 2 were used.

The raise is enlarged from the elevation of the production level access drift 13 to an elevation spaced apart from the bottom of the base of operation on the working level; that is, the top of the enlarged raise is below the floor or sill of the central drift 16. Thus, the floor of the base of operation has only the original bore four foot diameter hole over the raise 23 after the raise is enlarged and this can easily be covered with a steel grate for safety. The unfragmented formation between the top of the enlarged raise 23 and the bottom of the central drift 16 of the base of operation is a portion of a horizontal sill pillar 26 left between the floor of the base of operation and the top of the fragmented permeable mass of particles formed later in preparation of the in situ oil shale retort.

The term "horizontal sill pillar" is not known to have any recognized meaning in the mining art. The term "sill" is sometimes used in the mining art for the floor of a gallery or passage in a mine. The term "pillar" is sometimes used for in situ rock left to support overlying strata, for ground control or the like. The "horizontal sill pillar" 26 is left below the floor of the base of operation to provide support thereof. The sill pillar cooperates with the working level pillars 18 in supporting the roof or "back" of the base of operation. In an exemplary embodiment the vertical thickness of the unfragmented horizontal sill pillar is about 40 feet.

After the initial bored raise 22 has been enlarged to a generally square raise 23, additional excavation enlarges the raise in a horizontal direction to form a slot 27 having its bottom portion in communication with the production level access drift 13 and its top boundary about 40 feet below the sill or floor of the base of operation on the working level to form a horizontal sill pillar. The slot is excavated by drilling blasting holes downwardly from the central drift 16 of the base of operation parallel to and spaced apart from the enlarged raised 23. A pattern of such blasting holes is illustrated in FIG. 6. Three blasting holes 28 are drilled parallel to the existing square raise 23. The blasting holes 28 are loaded with explosive from the base of operation up to a level corresponding to the top of the slot it is desired to form; i.e. the blasting holes are loaded only to about 40 feet below the bottom of the base of operation. The portion of each blasting hole within the sill pillar, that is; the portion above the explosive is filled with sand or small size gravel for stemming to inhibit breakage into the horizontal sill pillar 26, which is to be left unfragmented.

Explosive in the three blasting holes 28 is then detonated in a single round to fragment the formation within the region bounded by the freehand line 29 in FIG. 6 and expand it toward the existing square raise 23. Explosive in the several blasting holes 28 is preferably detonated with short time delays between successive holes for maximizing fragmentation and minimizing seismic effects of large blasts. Thus, the example, the explosive in the blasting holes 28 can be detonated in sequence; the center hole first; with about 50 milliseconds delay between each successive detonation. The fragmented formation from such blasting is drawn by way of the drift 13 for disposal.

Successive enlargements of the raise to excavate the slot proceeds by drilling additional blasting holes 30 from the central drift 16 of the working level base of operation, loading explosive into such holes, and detonating them in a manner similar to that hereinabove described with reference to the blasting holes 28. One such increment is illustrated in FIG. 6. Additional such increments as required are fragmented on one or both sides of the initial raise 23 to form a slot extending to the side boundaries 12 of the retort site.

In a working embodiment wherein an 18 to 20 foot slot was desired, the two outer blasting holes 28 were about 15 feet apart and the burden to the square raise was about 10 feet. Overbreak from the slot blasting and scaling from the sides of the square raise brought the average width of the resultant slot to about 20.7 feet. Enlargement of the slot by repeating such explosive expansion brought the total length to about 117 feet.

The depth of the slot (from the floor of the base of operation) ranged from about 257 feet in the center near the production level drift to about 207 feet at each end of the slot. Alternatively, the outer two blasting holes used for enlarging the slot can be lightly loaded with explosive to minimize overbreak and spaced further apart. Most of the formation is expanded by explosive in the center, more heavily loaded blasting hole and the outer two holes, which are detonated later, trim the corners.

Since the lower production level drift 13 (FIGS. 2 to 5) provides a single draw point for the fragmented formation excavated in forming the slot, the bottom of the slot at each side of the tunnel is left sloping towards the drift. Pre-split holes are drilled upwardly from the production level drift at about 45° from vertical, loaded with explosive, and detonated to form a shear plane for the slot blasting holes. Thus, the bottom walls 34 of unfragmented formation slope toward the drift 13 at an angle of about 45° . This assures that the slope is greater than the angle of slide of the fragmented formation so that good drawing of the fragmented formation occurs for excavation by way of the production level access drift 13. The sloping bottom of the slot can be obtained by drilling the blasting holes (e.g., 28 and 30 in FIG. 6) used for enlarging the raise in a horizontal direction, down to an elevation just below the pre-split shear plane of the sloping bottom. Drilling the blasting holes to a somewhat lower level than the 45° shear plane can reduce the slope of unfragmented formation at the bottom of the slot, but fragmented formation accumulates towards the sides to yield an effective slope of about 35° to 45° from horizontal.

Thus, when the slot 27 is completed it has ends 31, side walls or faces 32, a top 33, and two sloping bottom walls 34. The ends 31 of the slot extend to the side boundaries of the fragmented permeable mass to be formed in the in situ oil shale retort site. The longer side walls 32 provide vertically extending free faces within the side boundaries of the fragmented permeable mass of particles to be formed in the in situ oil shale retort site. In this embodiment the side boundaries of the fragmented permeable mass of particles formed by the expansion of formation towards the void formed by the vertical slot coincide with the side boundaries of the in situ oil shale retort site.

In other embodiments a plurality of slots can be used and in such a case the boundaries of the fragmented permeable mass expanded toward one such void may not coincide with all of the side boundaries of the retort site. Thus, the example, in an embodiment disclosed in U.S. Pat. Application Ser. No. 603,705, a pair of slots are employed and separate parts of formation between the slots are expanded toward the respective slots. A plurality of slots can be formed beneath a horizontal sill pillar.

At this stage of formation of the in situ oil shale retort three is a group of interrelated excavations. A lower production level drift 13 provides means for access to the lower boundary of the in situ oil shale retort site. A slot-shaped void extends upwardly from the access means at the production level. The formation on each side of the slot forms a large planar wall providing a free face towards which formation within the retort site is later expanded. A base of operation on the working level lies above the slot, leaving intact formation as a portion of a horizontal sill pillar between the top of the slot and the sill or floor of the base of operation. The sill pillar which in a working embodiment is about 40 feet thick is strong enough to withstand subsequent explosive expansion of formation toward the void for maintaining a safe base of operation after formation of the fragmented mass. The base of operation in this embodiment comprises an array of a plurality of elongated drifts and roof supporting pillars of intact formation. The base of operation provides access for drilling blasting holes downwardly in the formation in the in situ oil shale retort site.

After the slot 27 is excavated, final preparations are made for expanding a remaining portion of the formation within the retort site toward the void. Some of the preparations can be conducted concurrently with enlargement of the raise to form the slot-shaped void. A plurality of blasting holes are drilled downwardly in the formation within the retort site from the side drifts 17 of the base of operation. In the arrangement illustrated in FIG. 5 five such blasting holes, each ten inches in diameter, are in each of two rows parallel to the large side walls of the slot 27. The pattern of ten blasting holes on each side of the slot is similar to the pattern on the other side of the slot.

The first or inner row of blasting holes 36 is along the roof supporting pillar 18 on the opposite side thereof from the central drift 16 of the base of operation. An outer row of blasting holes 37 is drilled downwardly along the side boundary of the fragmented permeable mass of particles to be formed in the in situ oil shale retort site. Such blasting holes are drilled from the side drifts 17 on the working level.

The "burden distance" is the distance between the blasting holes and the nearest free face of material to be explosively expanded. The burden distance for the blasting holes in the inner row 36 is the distance between the blasting holes and the adjacent large side wall of the slot-shaped void 27. The burden distance for the outer row of blasting holes 37 is the distance between the blasting holes in that row and the inner row 36. This is the case since explosives in blasting holes in the inner row 36 are detonated a fraction of a second before detonating explosives in adjacent blasting holes in the outer row 37. Such earlier detonation creates new free faces, adjacent the blasting holes 36 in the inner row. Formation is thereafter expanded toward such new free faces by detonation of explosives in the outer blasting holes 37. The burden distance for the outer blasting holes 37 is considered to be the distance between such holes and a newly created free face extending along the inner row of blasting holes 36.

The spacing distance for blasting holes is the distance between adjacent holes in a direction parallel to the free face, that is, for example, the spacing between adjacent holes in one of the rows 36 or 37 illustrated in FIG. 5.

In a working embodiment for forming a fragmented permeable mass about 118 feet square in horizontal cross section, a burden distance between the free face formed by the wall of the slot and the first row of blasting holes was about 25 feet. A similar burden distance was used between adjacent rows of blasting holes 36 and 37. A somewhat larger spacing distance, almost 30 feet between adjacent blasting holes in each row, was used.

Figure 7:
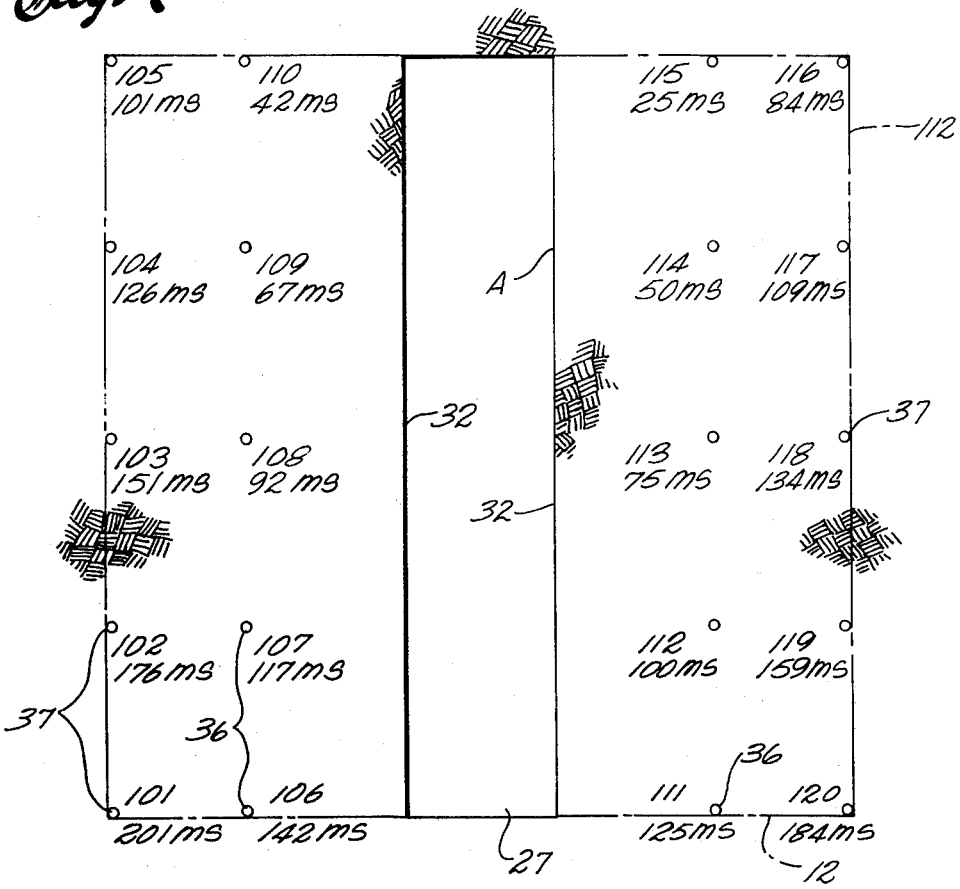
FIG. 7 is a semi-schematic horizontal cross section of the retort site illustrating a suitable blasting pattern for expanding formation toward the slot.

FIG. 7 is a semi-schematic horizontal cross section of the in situ oil shale retort site showing a blasting pattern suitable for forming a fragmented permeable mass of particles about 118 feet square in an in situ oil shale retort. In this drawing the side boundaries 12 of the fragmented permeable mass of particles to be formed in the in situ oil shale retort site are indicated by phantom lines.

Explosive is loaded into each blasting hole 36 and 37 and is detonated in all of the blasting holes in a single round, tht is, in an uninterrupted series of explosions. Each of the blasting holes 36 and 37 illustrated in FIG. 7 is identified with a numeral from 101 through 120 for identification. Beside each hole in FIG. 7 is a time interval ranging from 25 ms (milliseconds) to 201 ms. These time intervals indicate the sequence and time of detonation of explosive in the respective blasting holes in one working embodiment. Thus, blasting hole No. 115 is fired first, about 25 milliseconds after initiation, followed by blasting hole No. 110, followed by blasting hole No. 114, et seq., through firing of blasting hole No. 101 about 201 milliseconds after initiation, thus, a short time delay occurs between each successive detonation, so that no two blasting holes are detonated simultaneously, thereby minimizing seismic effects from the explosive. The significance of this can be appreciated when it is recognized that each such blasting hole can contain more than four tons of explosive.

Such a sequence of detonations continually creates new free faces for adjacent blasting holes for enhancing fragmentation of the formation. Thus, for example, upon detonation of explosive in hole No. 115 a generally V-shaped segment of formation between the blasting hole and the free face at the wall 32 of the slot is expanded toward the free face. The blasting hole 115 is at the apex of the wedge-shaped segment. This creates new free faces running roughly from blasting hole No. 115 to the corner of the slot and diagonally from hole No. 115 to an intersection with the wall 32 at a location indicated at A in FIG. 7 approximately between blasting holes 109 and 114. Detonation of explosive in blasting hole No. 114 expands formation toward the newly created diagonal free face and toward the free face at the wall 32 of the slot, thereby creating a new free face running roughly between holes 114 and 115 and then diagonally to intersect the wall of the slot approximately between holes 108 and 113. Such a sequence of expansion towards the slot or newly created free faces continues on both sides of the slot through the rest of the blasting pattern.

It will be recognized that although generally wedge-shaped segments are broken between newly created free faces the expansion of the formation is only one directional, that is generally toward the free face at the slot wall 32. It will also be apparent that other blasting sequences can be employed for assuring expansion of the formation to form a fragmented permeable mass of particles in an in situ oil shale retort Referring again to FIGS. 2 to 5, when the blasting holes in rows 36 and 37 are drilled, the bottoms are at levels approximately corresponding to projections of the sloping bottom walls 34 of the slot. Thus, the blasting holes nearer the intersection of the drift 13 and slot 27 are relatively longer so that the bottoms of the holes are relatively near the level of the top of the drift and the lengths of the blasting holes are progressively shorter so that the shortest holes are nearer the side boundaries of the fragmented permeable mass of formation being formed. That is, the shortest holes are at the ends of the rows 36 and 37, and the longest holes are near the middle thereof. Thus, when the remaining portion of formation is expanded toward the slot, the fragmented permeable mass of particles has a lower boundary corresponding to the sloping walls 14 illustrated in FIG. 1.

In a working embodiment having dimensions as set out above and the blasting pattern described and illustrated in FIG. 7 a total of about 170,150 pounds of explosive was used in the 20 blasting holes used for explosively expanding formation toward the slot. The bottom portion of each blasting hole was loaded with about 7500 to 9000 pounds of an aluminized TNT slurry explosive having an available energy of about 943 calories per gram. The column of explosive extended from the bottom of each hole up to about 50 feet below the floor at the working level. The next ten feet in each hole was loaded with a TNT slurry explosive having an available energy of about 750 calories per gram. Loading density was estimated at about 1.55 grams per cubic centimeter. Based on a weight of formation expanded towards the slot of about 137,087 tons, the powder factor was about 1.24 pounds of explosive per ton of formation.

Explosive is loaded into the blasting holes only to a level up to about 40 feet below the floor or sill of the base of operation so as to leave the horizontal sill pillar 26 intact between the fragmented permeable mass of particles and the over-lying base of operation on the working level. The blasting holes are stemmed with inert material such as sand or small gravel over the explosive to minimize overbreak of formation above the level of the explosive. Thus, in a working embodiment, the blasting holes were stemmed from about 40 feet below the floor of the working level base of operation. Detonation of explosive in the blasting holes for expanding formation toward the slot thereby leaves intact formation as a horizontal sill pillar between the fragmented permeable mass so formed and the base of operation. The sill pillar has a sufficient thickness that the base of operation is safe after explosive expansion.

In the working embodiment described herein the horizontal sill pillar between the top of the fragmented permeable mass of particles and the floor of the base of operation had a thickness of about 40 feet to withstand the stresses of blasting upon explosive expansion of the formation to form the fragmented permeable mass. With a blasting sequence as hereinabove described and illustrated in FIG. 7, the rib pillars are sufficiently strong to withstand blasting induced stresses.

Several factors can be considered in determining the thickness of sill pillar and arrangement of the base of operation over the fragmented mass in an in situ oil shale retort. It has been indicated in the literature that failure in a roof supporting pillar subject to short term stresses can occur at loads about 16% above those loads leading to failure under long terms loads. Known techniques of incipient failure analysis can therefore be employed for determining adequate strength of the roof supporting pillars on the working level since blasting loads are imposed for only about 12 milliseconds. In the described working embodiment 25 millisecond delays between each detonation are employed on each side of the slot. Ample time is, therefore, available for decay of blasting stresses on the pillars between sequential detonations. Adequate pillar design can therefore be assured by analysis of incipient failure under long term loads with an adequate safety margin for the short term loads imposed by blasting.

The slot between the portions of formation being expanded partially isolates portions of the horizontal sill pillar from some of the blasting stresses. Detonation of explosive on one side of the slot largely acts on the sill pillar and roof supporting pillars on that side of the slot and only minimally on the opposite side of the slot.

Blast imposed bending and shearing stresses are believed greatest in regions of the sill pillar having the largest span between roof supporting pillars. In the working example having a generally E-shaped excavation on the working level, the cross cut 19 between the center drift and each side drift is about 30 feet wide and it represents the portion of the sill pillar estimated to have the highest stress, i.e., that portion most likely to be subject to failure upon blasting. Because of the 40 foot thickness of the sill pillar in the working example there is more than adequate strength to withstand blasting loads, even in this part of the base of operation.

Tensile scabbing of a slab from the floor of the base of operation on the overlying working level due to imposed blasting loads can also be considered. The slab between roof supporting pillars can be considered a uniformly loaded beam subject to bending and resultant tensile stress at the top. In the working example, the highest tensile fiber stress due to blasting was predicted in the access entry cross cuts 19. It was calculated that when more than 9 tons of TNT slurry is simultaneously detonated the tensile fiber stress is only about 67 psi. A pre-existing static compressive stress of at least 200 psi in the floor prevents tensile scabbing of the floor. When smaller amounts of TNT slurry or similar amounts of less energetic ANFO are detonated, tensile stress levels are smaller.

It is significant that the sill pillar have an effective thickness between the top of the fragmented mass and the floor of the overlaying working level greater than the burden distance between blasting holes and the nearest free face towards which formation is expanded upon blasting. If the distance from the floor of the working level to explosive used for explosive expansion is less than the burden distance, explosive expansion into the working level could be encountered. In the working example the horizontal sill pillar has a thickness of about 40 feet and the burden distance between the first row 36 of blasting holes and the slot is about 25.5 feet. The burden distance for the second row 37 of blasting holes is also about 25.5 feet.

An in situ oil shale retort according to the working example described herein has been formed. A fragmented mass of particles about 118 feet square and extending about 210 feet above a production level access drift was formed by explosive expansion of formation in the retort site towards a vertically extending slot as hereinabove described. A horizontal sill pillar about 40 feet thick overlies the fragmented mass and provides a safe base of operation providing access over substantially the entire horizontal cross section of the fragmented mass. The formation in the sill pillar is believed to have remained integral during explosive expansion and the permeability of the formation forming the sill pillar remains about the same as before explosive expansion. Measurements of permeability made in the ten inch blasting holes in the sill pillar suggested an increase in permeability and a damage zone around each hole could be observed. In one hole through the sill pillar a fracture pattern was observed to involve continuous fracture the length of the hole, bad breakage for about one or two feet at a distance about 15 feet below the floor of the base of operation, and increasing fracture and breakage as the bottom of the sill pillar is approached. The damage zone along the ten inch blasting hole surface is believed to be only a surface condition with little depth. This view is based on the facts that holes drilled through the sill pillar after explosive expansion do not show this surface damage and that most of the damage can be removed by reaming a ten inch hole to a twelve inch diameter. Visual observations in the four foot diameter raise which extended through the sill pillar indicated limited movement along pre-existing fractures and minor scaling at intersections of joints and fractures with the raise surface.

Measurements were made of the thickness of the sill pillar after explosive expansion of formation beneath the sill pillar. Measurements were made by TV camera examination and/or mechanical calipers through holes extending through the sill pillar from the base of operation. Some of the measurements were ambiguous because of the presence of the fragmented mass against the bottom of the sill pillar. Measurements of the thickness of the sill pillar ranged from about 37 feet to about 50 feet.

The base of operation on the working level extends over substantially the entire horizontal cross section of the fragmented mass so that there is access to the top of the fragmented mass. The base of operation is safe for entry of men and equipment for operating the retort. Some scaling of loose rock from the walls was needed after the blast which formed the fragmented mass. No significant blast damage to the sill pillar or the roof supporting pillars was noted.

Thus, by keeping the top of the slot about 40 feet or more below the floor of the working level, and stemming explosive in blasting holes at about the same level as the top of the slot, a stable horizontal sill pillar remains intact after explosive expansion of formation to form a fragmented permeable mass of particles beneath the sill pillar. The stability of the horizontal sill pillar under either static loads or the dynamic loads of blasting assures that a safe base of operation remains after explosive expansion. A safe base of operation means that men and equipment can reenter the base of operation after explosive expansion to conduct additional operations for preparing and operating an in situ oil shale retort.

After a fragmented permeable mass of particles has been formed by expanding formation toward a void below the horizontal sill pillar, either of two courses can be followed. Retorting of the fragmented permeable mass beneath the intact sill pillar can be conducted from the base of operation. Alternatively, the roof supporting pillars and sill pillar (and possibly part of the roof or back above the working level) can be explosively expanded to increase the fragmented permeable mass of particles available for retorting.

If this latter course is followed the drifts of the base of operation provide a void toward which the roof supporting pillars and sill pillar can be expanded. For this purpose blasting holes are drilled into the working level pillars for explosive expansion thereof. Additional blasting holes can be drilled into the sill pillar and/or the already existing blasting holes can be cleaned, redrilled or reamed to the extent needed for placement of explosives. If desired, blasting holes can also be drilled upwardly into the roof above the base of operation. If this is done one can also drill blasting holes to different heights to deliberately provide a domed top to the in situ oil shale retort being formed.

Such blasting holes drilled into the formation are loaded with explosive from the base of operation. Such explosive is then detonated in a single round to explosively expand the roof supporting pillars and horizontal sill pillar (and possibly part of the formation above the working level) toward the base of operation. Preferably the roof supporting pillars are first expanded, followed by explosive expansion of the sill pillar. In an exemplary embodiment the fragmented permeable mass of particles formed by expanding the sill pillar and roof supporting pillars has an average void fraction of about 23%. If 10 feet of the roof over the base of operation is also expanded toward the base of operation the average void fraction is about 20%.

If the sill pillar is to be expanded toward the working level base of operation an air level drift 47 is excavated at a level above the working level as seen in phantom in FIG. 3. A four foot diameter diagonal conduit 48 is bored between the air level drift 47 and the roof of the base of operation, preferably before the sill pillar is expanded. If desired additional conduits (not shown) can be formed between the working level base of operation and air level drift. After the sky pillar is expanded such a conduit 48 (or conduits) serves for ignition of the fragmented permeable mass and for introducing retorting gas such as oxygen containing gas to the top of the fragmented permeable mass of particles for retorting oil shale therein. Alternatively retorting gas can be introduced by way of the access drift 21 on the working level.

There are advantages to leaving the sill pillar intact after forming a fragmented mass beneath it and conducting retorting operations from the safe base of operation thereabove. A relatively uniform array of blasting holes remains perforating the horizontal sill pillar. These blasting holes can be readily cleaned out, reamed and/or redrilled if necessary, after the fragmented permeable mass of particles below the sill pillar has been formed. A void can also be formed in the fragmented mass at the lower end of some or all of the blasting holes to minimize gas flow resistance between the lower end of the hole and the fragmented mass. Additional holes for gas introduction or instrumentation can be drilled. Processing gas is introduced through at least some of the holes to the top of the fragmented permeable mass. Ignition through a plurality of holes assures uniformity of a combustion zone established in the fragmented permeable mass. Gas flow through the plurality of holes through the intact sill pillar can be readily monitored and controlled for control of the retorting operation. The safe base of operation above the fragmented permeable mass of particles is also convenient for making other measurements of retort operation for optimum control. Access is readily obtained to all portions of the top of the fragmented mass in the in situ retort. Equipment instrumentation and the like can be located in the base of operation without additional excavation. The base of operation provides a means for access to the retort for many years for conducting post retorting operations.

Two principal levels are described and illustrated hereinabove for forming an in situ oil shale retort, namely a production level adjacent the bottom of the retort and a working level above the horizontal sill pillar. An additional air level can be provided at a higher elevation in an embodiment wherein the sill pillar is also explosively expanded. Levels of excavation between the production level and the working level can be provided in some embodiments. Thus, for example, an in situ oil shale retort can be formed by excavating a plurality of vertically spaced apart voids within the volume to become the fragmented permeable mass in an in situ oil shale retort. Formation remaining between the voids is explosively expanded towards the horizontal free faces of such voids, as contrasted to explosive expansion towards the vertical free faces adjacent the slot hereinabove described. Techniques for forming a fragmented mass are described in copending U.S. Patent applications Ser. No. 659,899, entitled MULTIPLE ZONE PREPARATION OF OIL SHALE RETORT, filed Feb. 20, 1976, by Gordon B. French and Donald E. Garrett, now U.S. Pat. No. 4,043,598, and Ser. No. 658,688; entitled MULTIPLE LEVEL PREPARATION OF OIL SHALE RETORT, filed Feb. 17, 1976, by Gordon B. French, now U.S. Pat. No. 4,043,597, and assigned to the assignee of this application. The disclosures of these applications are hereby incorporated by reference as if set forth in full herein.

In an arrangement as set forth in these applications, a production level can be provided at or below the elevation of the bottom of a retort. One or more intermediate levels can be excavated at elevations above the production level. These intermediate level excavations are for excavation of horizontally extending voids having horizontal cross sections corresponding to the horizontal cross section of the in situ oil shale retort being formed. A base of operation can be provided on a working level above the fragmented mass formed by explosive expansion of formation towards a void or voids on one or more intermediate levels. A horizontal sill pillar of unfragmented formation is left between the top of the fragmented mass and the working level to provide a safe base of operation giving access over substantially the entire horizontal cross section of the fragmented mass.

Any suitable arrangement of drifts, tunnels, adits, cross cuts and roof supporting pillars and the like can be utilized on the production and working levels (and intermediate levels if employed) for forming a retort, retorting oil shale or recovering liquid and gaseous products from a retort. The array of elongated drifts 16 and 17 and roof supporting pillars 18 hereinabove described and illustrated in FIGS. 2 to 5 is exemplary of one embodiment of a base of operation for forming an in situ oil shale retort. Other arrays of drifts and roof supporting pillars of intact formation are also suitable for forming in situ oil shale retorts.

Figure 8:
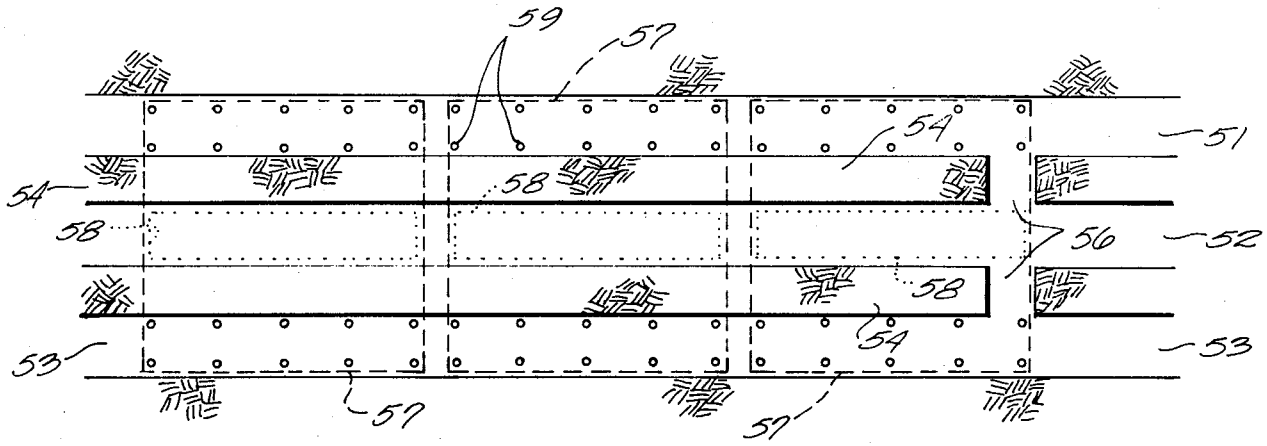
FIG. 8 is a horizontal cross section of another embodiment of a base of operation.

Thus, for example, FIG. 8 illustrates in horizontal cross section another array of drifts and roof supporting pillars on a working level in a subterranean formation. As illustrated in this embodiment there are a plurality of elongated drifts or galleries 51, 52, and 53 with elongated roof supporting pillars 54 of intact formation left between adjacent galleries. Occasional cross cuts 56 can be provided through the roof supporting pillars 54 to interconnect adjacent galleries. Such cross cuts are useful in providing underground ventilation as well as facilitating movement of equipment through the underground workings on the working level.

The array of galleries and working level pillars are employed in preparation of a plurality of in situ oil shale retorts 57 indicated by the dashed lines in FIG. 8. This drawing represents the retort sites at an intermediate stage before explosive expansion to form fragmented permeable masses of formation coinciding with the boundaries 57 illustrated. A slot 58 as indicated by dotted lines in FIG. 8 is formed in each in situ oil shale retort site 57. Each of the slots is formed beneath one of the tunnels 52 so that the top of the slot is spaced below the bottom of the base of operation. This leaves a portion of intact formation forming a horizontal sill pillar between the slot and the working level as hereinabove described and illustrated. The slots 58 are formed in the same general manner as hereinabove described and illustrated.

The roof supporting pillars 54 on the working level in this embodiment are elongated in a direction parallel to the slot 58 in an in situ oil shale retort site. The width or thickness of the roof supporting pillar, that is, the distance between a pair of adjacent galleries 51 and 52, is about the same as the burden distance between the slot and blasting holes 59 drilled downwardly from one of the galleries 51. This permits access from the working level base of operation for drilling blasting holes both for forming the slot and for subsequent explosive expansion of a remaining portion of formation within boundaries of the in situ oil shale retort site toward the slot. In many respects this array of galleries is similar to that in FIGS. 2 to 5 but the galleries extend beyond the individual retort sites instead of having boundaries coinciding with retort boundaries.

The continuous array of galleries and pillars on the working level illustrated in FIG. 8 provides access over substantially the entire horizontal cross section of the fragmented mass in each retort. A plurality of retorts can be formed and operated from the base of operation either individually or in groups.

Figure 9:
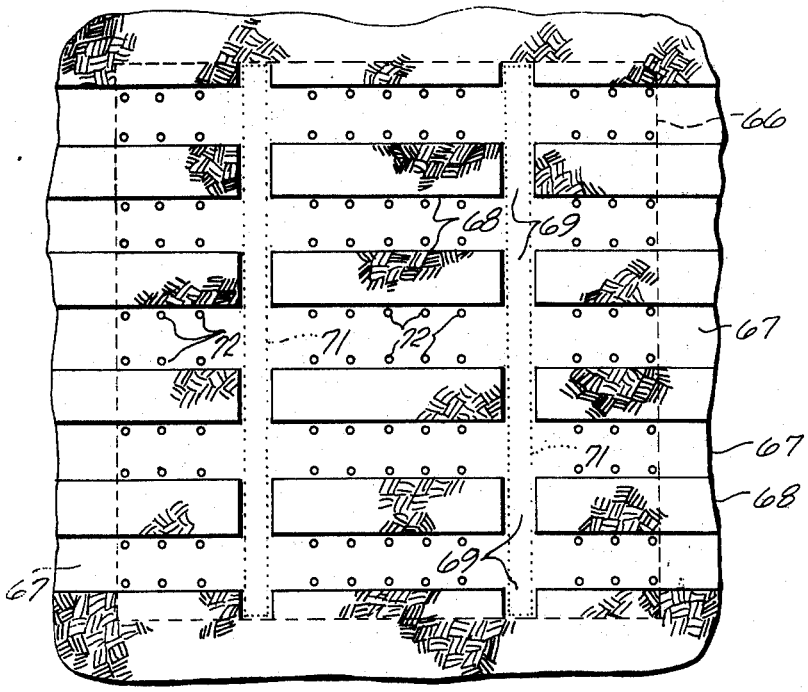
FIG. 9 is a horizontal cross section of still another embodiment of a base of operation.

FIG. 9 illustrates in horizontal cross section another array of galleries and working level pillars suitable for forming an in situ oil shale retort. As illustrated in this embodiment an in situ oil shale retort 66 is being formed as indicated by the dashed lines. A working level base of operation is excavated in the form of a plurality of parallel tunnels or galleries 67. Pillars 68 of intact formation are left in place between adjacent galleries 67 for supporting the overlying roof. Cross cuts 69 are provided periodically through the roof support pillars 68 so that the array of galleries and pillars is essentially a rectangular network.

In the in situ oil shale retort 66 a pair of slots 71 are excavated beneath the base of operation as indicated by the dotted lines in FIG. 9. The slots are excavated beneath the cross cuts 69 so that there is access from the base of operation to all portions of the slots to aid in their excavation. A plurality of blasting holes 72 are drilled downwardly from the base of operation into a remaining portion of formation in the in situ oil shale retort site. Such blasting holes are loaded with explosives and detonated sequentially for expanding the remaining portion of formation towards the two slots 71. Thus, in the retort volume illustrated in FIG. 9 two parallel slots are employed for providing vertically extending voids towards which remaining portions of the formation are expanded.

In this embodiment the working level pillars 68 are horizontally elongated in a direction perpendicular to the length of the slots 71. The thickness or width of the pillars, that is, the distance between adjacent galleries 67, corresponds approximately to the spacing distance between blasting holes 72. Often the spacing distance between blasting holes is somewhat larger than the burden distance. This permits the rib pillars to be somewhat wider than in an embodiment where pillar width is determined by a desired burden distance. The volume of rock excavated from the working level base of operation in the embodiment of FIG. 9 is approximately equivalent to or somewhat less than the embodiment illustrated in FIG. 8.

In either of the embodiments of FIGS. 8 or 9, a number of voids can be excavated in an in situ oil shale retort site. The array of elongated galleries and pillars on the working level can be extended indefinitely to provide a working level base of operation for forming such in situ oil shale retorts over a large area. Thus, for example, in one embodiment an in situ oil shale retort site is about 485 feet by 830 feet. Formation within such a retort site is expanded toward five parallel slots each 485 feet long. Six or seven galleries similar to the elongated tunnels or galleries 67 in FIG. 9 extend in a direction perpendicular to the length of the slots. Other large arrays of galleries and working level pillars can be employed for large in situ oil shale retorts or patterns of smaller retorts. Continuous arrays of galleries as illustrated in FIGS. 8 and 9 are particularly useful for embodiments where access to the base of operation is maintained during retorting operations of individual retorts below a horizontal sill pillar.

In either of the embodiments of FIGS. 8 and 9 the working level pillars are elongated. Square pillars or other configurations can be used commensurate with access to portions of the in situ oil shale retort site for drilling blasting holes and need to maintain a safe base of operation above a horizontal sill pillar after explosive expansion of formation beneath the sill pillar. Such arrangements can be useful, for example, when the voids beneath the horizontal sill pillar are other than the slot shape hereinabove described and illustrated.

It will be recognized by those familiar with rock mechanics that the thickness of the horizontal sill pillar can differ from the exemplary 40 feet mentioned above for maintaining a safe base of operation. When areas are small and the base of operation is to remain open only temporarily, followed by explosive expansion of the horizontal sill pillar, the vertical thickness of the sill pillar can be less than indicated. The sill pillar can be thicker, if desired for greater margins of safety or where stresses of geologic formations or blasting are higher. The competency of the strata forming the sill pillar can also influence the desired thickness of the horizontal sill pillar.

It is preferred in each embodiment that the volume of the void or voids excavated within the boundaries of the in situ oil shale retort be sufficiently small relative to the volume of the remaining portion of the formation which is to be expanded towards the void that the resultant fragmented permeable mass fills the combined volumes of the void and remaining portion of the formation up to the bottom of the horizontal sill pillar. To fill such an in situ oil shale retort, the void fraction of the fragmented mass should be less than about 40%. If the void fraction is greater than about 40%, the fragmented permeable mass will not fill the volume up to the bottom of the sill pillar. Preferably the volume of the excavated void is in the range of from about 15 to about 25% of the volume of the fragmented permeable mass to be formed. This results in a fragmented permeable mass having an average void fraction in the range of from about 15 to 25%. This assures good permeability in the fragmented mass and substantial filling of the volume below the sill pillar.

By having the fragmented mass fill the volume up to the bottom of the sill pillar, substantial bearing support for the sill pillar and overlying formation is provided by the fragmented mass. Such bearing support minimizes the proportion of overburden loads which might otherwise be transferred to unfragmented formation adjacent the side boundaries of the fragmented mass. This helps maintain uniform stresses in formation at the working level above the fragmented mass and helps maintain a safe base of operation.

When a fragmented mass fills the volume below the bottom of a horizontal sill pillar, localized voids can be present due to blasting or geologic conditions. The fragmented mass is still considered to fill the volume below the sill pillar regardless of such localized voids adjacent the bottom of the horizontal sill pillar. Localized voids can be formed in the fragmented mass adjacent the bottom of some or all of the blasting holes after explosive expansion. Such voids help minimize gas flow resistance between the bottom of the hole and adjacent fragmented mass. Portions of the fragmented mass remaining in tight engagement with the bottom of the sill pillar provide support to the sill pillar.

In a working embodiment a fragmented permeable mass was formed having an average void fraction less than about 20%. In most areas the top of the fragmented mass was in tight engagement with the bottom of the sill pillar. In one area a shallow void was found between the top of the fragmented mass and the bottom of the sill pillar. The void averaged about 80 feet in length and has an average width of about 17.5 feet. Other localized voids having smaller areas were found in other locations under the sill pillar. The presence of such voids did not prevent the overlying working level above the horizontal sill pillar from providing a safe base of operation for entry of men and equipment.

Although limited embodiments of technique for forming an in situ oil shale retort or retorts have been described and illustrated herein many modifications and variations will be apparent to one skilled in the art. Such variations for expeditiously forming retorts and maintaining a safe base of operation above a horizontal sill pillar should be considered to be within the scope of the appended claims.

What is claimed is:

1. A method of recovering liquid and gaseous products from an in situ oil shale retort in a subterranean formation containing oil shale, such an in situ oil shale retort containing a fragmented permeable mass of particles containing oil shale, said fragmented mass having top, bottom and side boundaries, comprising the steps of:

excavating a first portion of the formation to form a base of operation at a level in the formation above the top boundary of the fragmented mass being formed, the horizontal extent of the base of operation being sufficient to provide effective access to substantially the entire horizontal cross section of the fragmented mass being formed;

excavating a means for access through the formation to a location underlying the base of operation;

excavating a second portion of the formation from within the boundaries of the fragmented mass being formed to form at least one void, the surface of the formation defining such a void providing at least one free face extending through the formation within the boundaries of the fragmented mass being formed, and leaving a third portion of the formation, which is to be fragmented by expansion toward such a void, within the boundaries of the fragmented mass being formed and extending away from such a free face, and wherein such a void is spaced below the bottom of the base of operation, leaving sufficient unfragmented formation to form a horizontal sill pillar between the top of the void and the bottom of the base of operation, the vertical thickness of the horizontal sill pillar being at least sufficient that the horizontal sill pillar remains unfragmented after explosive expansion of said third portion toward the void;

drilling a plurality of blasting holes downwardly from the base of operation into formation within the boundaries of the fragmented mass being formed;

loading explosive into such blasting holes up to an elevation about the same as the bottom of the horizontal sill pillar;

stemming such blasting holes with inert material above an elevation about the same as the bottom of the horizontal sill pillar;

detonating such explosive for explosively expanding said third portion of formation toward such a void for forming a fragmented mass of particles below the horizontal sill pillar without fragmenting the horizontal sill pillar to provide a safe base of operation above the top boundary of the fragmented mass for effective access to substantially the entire horizontal cross section of the fragmented mass;

establishing a combustion zone in an upper portion of the fragmented mass below the horizontal sill pillar, the combustion zone having a temperature higher than an ignition temperature of oil shale;

introducing an oxygen containing gas to the fragmented mass through the horizontal sill pillar for sustaining the combustion zone and advancing the combustion zone through the fragmented mass;

withdrawing an off gas from a lower portion of the fragmented mass whereby gas flow on the advancing side of the combustion zone establishes a retorting zone and advances the retorting zone through the fragmented mass, thereby retorting oil shale in the fragmented mass and producing liquid and gaseous products, said gaseous products being withdrawn in the off gas; and withdrawing such liquid products from a lower portion of the fragmented mass.

2. A method as recited in claim 1 wherein, the burden distance between at least a portion of such explosive and such a free face is less than the vertical distance between the top of the fragmented mass being formed and the bottom of the base of operation.

3. A method as recited in claim 1 and wherein the void is excavated by forming a vertically extending slot between side boundaries of the fragmented mass being formed, the top of the slot being at about the same elevation as the bottom of the horizontal sill pillar left after explosive expansion, and wherein a portion of such explosive is detonated on each side of the slot for explosively expanding formation towards the slot from both sides of the slot and at least partially isolating a portion of the horizontal sill pillar on one side of the slot from blasting stresses from the opposite side of the slot.

4. A method as recited in claim 1 wherein the volume of the void relative to the volume of the fragmented mass being formed is sufficiently small that the fragmented mass provides support to the sill pillar.

5. A method as recited in claim 1 wherein such explosive is detonated in a single round with a short time delay between each successive detonation, so that no two blasting holes are detonated simultaneously.

6. A method of forming, in a subterranean formation containing oil shale, an in situ oil shale retort containing a fragmented permeable mass of particles containing oil shale, said fragmented mass having top, bottom and side boundaries, comprising the steps of:

excavating a first portion of the formation to form a base of operation at an elevation in the formation above the top boundary of the fragmented mass being formed and leaving unfragmented formation extending from the floor of the base of operation to the roof of the base of operation as at least one roof supporting pillar within the boundaries of the base of operation, such a roof supporting pillar having adequate strength to withstand short term loads imposed by explosive expansion to form the fragmented mass in the retort;

excavating a means for access through the formation to a location underlying the base of operation;

excavating a second portion of the formation from within the boundaries of the fragmented mass being formed to form at least one vertically extending void, the surface of the formation defining such a void providing at least one free face extending vertically through the formation within the boundaries of the fragmented mass being formed, and leaving a third portion of the formation, which is to be fragmented by expansion toward such a void, within the boundaries of the fragmented mass being formed and extending away from such a free face, and wherein such void extends vertically between the means for access and an elevation spaced below the bottom of the base of operation, leaving a horizontal sill pillar of intact formation between the top of the void and the bottom of the base of operation, the vertical thickness of the horizontal sill pillar being sufficient to maintain a safe base of operation after explosive expansion of said third portion toward such a void; and explosively expanding said third portion of formation toward such a void with a single round of explosions for fragmenting said third portion of formation without fragmenting the horizontal sill pillar or such a roof supporting pillar, thereby providing a safe base of operation above the top boundary of the fragmented mass having a sufficient horizontal extent to provide effective access to substantially the entire horizontal cross section of the fragmented mass.

7. A method as recited in claim 6 wherein the volume of the void relative to the volume of the third portion of formation expanded towards the void is sufficiently small that the fragmented mass fills the combined volumes of the void and the third portion to the bottom of the horizontal sill pillar.

8. A method as recited in claim 6 wherein the third portion of formation is explosively expanded towards the void by the steps of:

drilling a plurality of vertically extending blasting holes into the third portion of the formation from the base of operation;

loading explosive into the blasting holes from the base of operation up to an elevation about the same as the bottom of the horizontal sill pillar;

stemming the blasting holes with inert material above an elevation about the same as the bottom of the horizontal sill pillar; and detonating such explosive for explosively expanding and fragmenting said third portion of formation to form a fragmented permeable mass of particles below the horizontal sill pillar without fragmenting the horizontal sill pillar.

9. A method as recited in claim 8 wherein the burden distance between at least a portion of said blasting holes and such a free face is less than the vertical thickness of the horizontal sill pillar between the top boundary of the fragmented mass and the bottom of the base of operation.

10. A method as recited in claim 6 wherein the base of operation includes a drift between roof supporting pillars and the void is excavated by the steps of:

forming a vertical raise from the means for access to at least the elevation of the bottom of the horizontal sill pillar;

enlarging the raise in at least one horizontal direction to form a vertically extending slot having a bottom portion in communication with the means for access and a top portion of the bottom of the horizontal sill pillar, the length of the slot being parallel to and below said drift; and removing fragmented formation from enlarging the raise through the means for access.

11. A method as recited in claim 10 wherein such explosive is detonated in a single round with a short time delay between each successive detonation, so that no two blasting holes are detonated simultaneously.

12. A method as recited in claim 6 wherein the fragmented mass is formed by the steps of:

drilling a plurality of vertically extending blasting holes into the third portion of the formation from the base of operation;

loading explosive into at least a portion of the blasting holes from the base of operation up to an elevation about the same as the bottom of the horizontal sill pillar;

stemming the blasting holes with inert material above at least an elevation about the same as the bottom of the horizontal sill pillar; and detonating such explosive for explosively expanding said third portion of formation to form the fragmented permeable mass of particles below the horizontal sill pillar.

13. A method as recited in claim 12 wherein the burden distance between at least a portion of said blasting holes and such a free face is less than the vertical thickness of the horizontal sill pillar between the top boundary of the fragmented mass and the bottom of the base of operation.

14. A method as recited in claim 6 further comprising the step of loading explosive into blasting holes in the horizontal sill pillar after expanding said third portion of formation, and detonating such explosive for expanding the horizontal sill pillar toward the base of operation.

15. A method as recited in claim 6 further comprising the step of at least partly conducting operations for retorting the fragmented permeable mass from the base of operation above the horizontal sill pillar.

16. A method of forming, in a subterranean formation containing oil shale, an in situ oil shale retort containing a fragmented permeable mass of particles containing oil shale, said fragmented mass having top, bottom and side boundaries, comprising the steps of:

excavating a first portion of the formation to form a base of operation in an array of drifts and roof supporting pillars of intact formation at an elevation in the formation above the top boundary of the fragmented mass being formed;

excavating a means for access through the formation to a location underlying the base of operation;

excavating a second portion of the formation from within the boundaries of the fragmented mass being formed to form at least one void, the surface of the formation defining such a void providing at least one free face extending through the formation within the boundaries of the fragmented mass being formed, and leaving a third portion of the formation, which is to be fragmented by expansion toward such a void, within the boundaries of the fragmented mass being formed and extending away from such a free face, and wherein the top of such void is at an elevation spaced below the bottom of the base of operation, leaving a horizontal sill pillar of intact formation between the top of the void and the bottom of the base of operation, the vertical thickness of the horizontal sill pillar and the arrangement of roof supporting pillars in the base of operation being sufficient to maintain a safe base of operation after explosive expansion of said third portion toward such a void; and explosively expanding said third portion of formation toward such a void with a single round of explosions for fragmenting said third portion of formation without fragmenting the horizontal sill pillar or the roof supporting pillars, said drifts providing a base of operation for excavating said second portion of formation and for expanding said third portion of formation, said roof supporting pillars providing support between the horizontal sill pillar and overlying burden, thereby providing a safe base of operation above the top boundary of the fragmented mass having a sufficient horizontal extent to provide effective access to substantially the entire horizontal cross section of the fragmented mass.

17. A method as recited in claim 16 wherein the void is excavated in the form of an elongated vertical slot extending between side boundaries of the fragmented permeable mass of particles being formed and the drifts are excavated to leave roof supporting pillars elongated in a direction parallel to the length of the slot, the slot being excavated parallel to and directly below such a drift.

18. A method as recited in claim 17 wherein the third portion of formation is explosively expanded towards the slot by the steps of:

drilling a plurality of blasting holes downwardly into the third portion of the formation from at least a portion of the drifts;

loading explosive into the blasting holes from at least a portion of the drifts up to an elevation about the same as the bottom of the horizontal sill pillar;

stemming the blasting holes with inert material above an elevation about the same as the bottom of the horizontal sill pillar; and detonating such explosive for explosively expanding and fragmenting said third portion of formation to form a fragmented permeable mass of particles; and wherein the width of at least one of the elongated roof supporting pillars is about the same as the burden distance between at least a portion of the blasting holes and the slot.

19. A method of forming, in a subterranean formation containing oil shale, an in situ oil shale retort containing a fragmented permeable mass of particles containing oil shale, said fragmented mass having top, bottom and side boundaries, comprising the steps of:

excavating a portion of the formation to form a base of operation at an upper elevation in the formation above the top boundary of the fragmented mass being formed and leaving unfragmented formation extending from the floor of the base of operation to the roof of the base of operation as at least one vertical roof supporting pillar within the boundaries of the base of operation, the largest span between roof supporting pillars being sufficiently small to prevent tensile scabbing of the floor of the base of operation due to short term loads imposed by explosive expansion to form the fragmented mass in the retort; and detonating explosive in a single round of explosions for expanding formation below the base of operation for forming a fragmented permeable mass of formation particles with a top boundary at an elevation a sufficient distance below the base of operation to leave a horizontal sill pillar of unfragmented formation between the bottom of the base of operation and the top boundary of the fragmented mass for maintaining a safe base of operation, the fragmented mass having side boundaries located beneath the base of operation so as to provide effective access to essentially the entire horizontal cross section of the fragmented mass from the base of operation.

20. A method as recited in claim 19 wherein the fragmented mass is formed by the steps of:

excavating a second portion of the formation from within the boundaries of the fragmented mass being formed to form at least one void and leaving a third portion of the formation, which is to be fragmented by expansion toward such a void, within the boundaries of the fragmented mass being formed; and explosively expanding said third portion of formation toward such a void for fragmenting said third portion of formation without fragmenting the horizontal sill pillar, thereby providing a safe base of operation above the top boundary of the fragmented mass.

21. A method as recited in claim 20 wherein the step of explosively expanding comprises:

placing explosive in said third portion, the burden distance between such explosive and a free face of formation adjacent such a void being less than the distance between the top boundary of the fragmented mass and the bottom of the base of operation; and detonating such explosive for fragmenting said third portion.

22. A method as recited in claim 20 wherein explosive is detonated on each side of such a void for explosively expanding formation towards the void from both sides of the void and at least partially isolating a portion of the sill pillar on one side of the void from blasting stresses from the opposite side of the void.

23. A group of excavations in a subterranean formation containing oil shale, said group of excavations being at least partly within the boundaries of an in situ oil shale retort site comprising:

access drift means in the formation for access to a lower level of the in situ oil shale retort site;

a base of operation at a working level in the formation including a first drift at least partly directly above a portion of the access drift means, at least a second drift parallel to the first drift and separated therefrom by a first roof supporting pillar of unfragmented formation, and at least a third drift parallel to the first drift and separated therefrom by a second roof supporting pillar of unfragmented formation; and a slot-shaped void extending upwardly above the access drift means, the formation adjoining the slot-shaped void having a vertically extending free face, the top of the slot-shaped void extending parallel to said first drift and being at an elevation below the bottom of the base of operation to define a portion of a horizontal sill pillar between the void and the base of operation, the horizontal sill pillar having a sufficient thickness and the roof supporting pillars being arranged so that the horizontal sill pillar and roof supporting pillars can remain intact upon subsequent explosive expansion of formation horizontally toward said void, said first drift being directly above the slot-shaped void and providing effective access to essentially the entire horizontal cross section of the slot-shaped void.

24. A group of excavations as recited in claim 23 further comprising a plurality of vertically extending holes in the portion of the horizontal sill pillar between the top of the slot-shaped void and the bottom of the base of operation.

25. A group of excavations as recited in claim 23 further comprising a plurality of blasting holes extending downwardly in the formation from the second and third drifts of the base of operation adjacent to and spaced apart from such a free face and within the boundaries of the in situ oil shale retort site.

26. A group of excavations as recited in claim 23 wherein the roof supporting pillars extend in a direction parallel to the length of the slot-shaped void and the largest span between the roof supporting pillars is sufficiently small to prevent tensile scabbing of the floor of the base of operation upon subsequent explosive expansion of formation toward said void.

27. A group of excavations as recited in claim 23 wherein the drift means meets the slot-shaped void near the middle of the length of the slot-shaped void and the bottom of the void comprises first and second bottom walls each sloping downwardly from an end of the void toward the drift means at an angle about the same as the angle of slide of fragmented formation.

28. A method of forming an in situ oil shale retort in a subterranean formation containing oil shale, the in situ oil shale retort containing a fragmented permeable mass of formation particles containing oil shale, said fragmented mass having top, bottom and side boundaries, comprising the steps of:

excavating a first portion of the formation to form a base of operation at an elevation in the formation above the top boundary of the fragmented mass being formed;

excavating a second portion of the formation from within the boundaries of the fragmented mass being formed to form at least one slot, the surface of the formation defining the walls of such a slot providing a pair of parallel free faces extending vertically through the formation within the boundaries of the fragmented mass being formed, the top of the slot being spaced below the bottom of the base of operation to leave intact formation therebetween, the base of operation comprising at least three parallel drifts with a first drift overlying such a slot and at least one roof supporting pillar and one drift on each side of the first drift; and detonating explosive on each side of such a slot for explosively expanding a third portion of the formation remaining within the boundaries of the fragmented mass being formed and extending horizontally from said free faces toward such a slot from both sides of the slot for forming a fragmented permeable mass of formation particles and at least partially isolating a portion of the intact formation below the bottom of the base of operation and such a roof supporting pillar on one side of the slot from blasting stresses from the opposite side of the slot, thereby forming the fragmented mass without fragmenting formation between the elevation of the top of the slot and the bottom of the base of operation for leaving a horizontal sill pillar of unfragmented formation between the top boundary of the fragmented mass and the bottom of the bass of operation and without fragmenting such roof supporting pillars for maintaining a safe base of operation after forming the fragmented mass.

29. A method as recited in claim 28 wherein the third portion of formation is explosively expanded by the steps of:

drilling a plurality of blasting holes downwardly from the base of operation into the third portion, loading explosive into the blasting holes up to an elevation about the same as the top of the slot;

stemming the blasting holes with inert material above an elevation about the same as the top of the slot; and detonating such explosive for expanding the third portion toward such a slot.

30. A method as recited in claim 29 wherein the burden distance between at least a portion of said blasting holes and such a free face is less than the vertical thickness of the horizontal sill pillar between the top boundary of the fragmented mass and the bottom of the base of operation.

31. A method as recited in claim 26 wherein such explosive is detonated in a single round with a short time delay between each successive detonation, so that no two blating holes are detonated simultaneously.

32. A method of recovering liquid and gaseous products from an in situ oil shale retort in a subterranean formation containing oil shale, such an in situ oil shale retort containing a fragmented permeable mass of particles containing oil shale, said fragmented mass having top, bottom and side boundaries, comprising the steps of:

excavating a first portion of the formation to form a base of operation at a level in the formation above the top boundary of the fragmented mass being formed, and leaving unfragmented formation extending from the floor of the base of operation to the roof of the base of operation as at least one roof supporting pillar within the boundaries of the base of operation, the largest span between roof supporting pillars being sufficiently small to prevent tensile scabbing of the floor of the base of operation, due to short term loads imposed by explosive expansion to form the fragmented mass in the retort, the horizontal extent of the base of operation being sufficient to provide effective access to substantially the entire horizontal cross section of the fragmented mass being formed;

excavating a second portion of the formation from within the boundaries of the fragmented mass being formed to form at least one void, the surface of the formation defining such a void providing at least one free face extending through the formation within the boundaries of the fragmented mass being formed, and leaving a third portion of the formation, which is to be fragmented by expansion toward such a void, within the boundaries of the fragmented mass being formed and extending away from such a free face, and wherein such a void is spaced below the bottom of the base of operation, leaving unfragmented formation as a horizontal sill pillar between the top of the void and the bottom of the base of operation, the vertical thickness of the horizontal sill pillar being at least sufficient that the horizontal sill pillar remains unfragmented after explosive expansion of said third portion toward the void;

explosively expanding said third portion of formation toward the void for fragmenting said third portion of formation without fragmenting the horizontal sill pillar or such roof supporting pillar to provide a safe base of operation above the top boundary of the fragmented mass;

establishing a combustion zone in an upper portion of the fragmented mass below the horizontal sill pillar, the combustion zone having a temperature higher than an ignition temperature of oil shale;

introducing an oxygen containing gas to the fragmented mass through the horizontal sill pillar for sustaining the combustion zone and advancing the combustion zone through the fragmented mass;

withdrawing an off gas from a lower portion of the fragmented mass whereby gas flow on the advancing side of the combustion zone establishes a retorting zone and advances the retorting zone through the fragmented mass, thereby retorting oil shale in the fragmented mass and producing liquid and gaseous products, said gaseous products being withdrawn in the off gas; and withdrawing such liquid products from a lower portion of the fragmented mass.

33. A method of recovering liquid and gaseous products from an in situ oil shale retort in a subterranean formation containing oil shale, such as in situ oil shale retort containing a fragmented permeable mass of particles containing oil shale, said fragmented mass having top, bottom and side boundaries, comprising the steps of:

excavating a first portion of the formation to form a base of operation at a level in the formation above the top boundary of the fragmented mass being formed, and leaving unfragmented formation extending from the floor of the base of operation to the roof of the base of operation as at least one roof supporting pillar within the boundaries of the base of operation, such a roof supporting pillar having adequate strength to withstand short term loads imposed by explosive expansion to form the fragmented mass in the retort, the horizontal extent of the base of operation being sufficient to provide effective access to substantially the entire horizontal cross section of the fragmented mass being formed;

excavating a second portion of the formation from within the boundaries of the fragmented mass being formed to form at least one void, the surface of the formation defining such a void providing at least one free face extending through the formation within the boundaries of the fragmented mass being formed, and leaving a third portion of the formation, which is to be fragmented by expansion toward such a void, within the boundaries of the fragmented mass being formed and extending away from such a free face, and wherein such a void is spaced below the bottom of the base of operation, leaving unfragmented formation as a horizontal sill pillar between the top of the void and the bottom of the base of operation, the vertical thickness of the horizontal sill pillar being at least sufficient that the horizontal sill pillar remains unfragmented after explosive expansion of said third portion toward the void;

explosively expanding said third portion of formation toward the void for fragmenting said third portion of formation without fragmenting the horizontal sill pillar or such roof supporting pillar to provide a safe base of operation above the top boundary of the fragmented mass;

establishing a combustion zone in an upper portion of the fragmented mass below the horizontal sill pillar, the combustion zone having a temperature higher than an ignition temperature of oil shale;

introducing an oxygen containing gas to the fragmented mass through the horizontal sill pillar for sustaining the combustion zone and advancing the combustion zone through the fragmented mass;

withdrawing an off gas from a lower portion of the fragmented mass whereby gas flow on the advancing side of the combustion zone establishes a retorting zone and advances the retorting zone through the fragmented mass, thereby retorting oil shale in the fragmented mass and producing liquid and gaseous products, said gaseous products being withdrawn in the off gas; and withdrawing such liquid products from a lower portion of the fragmented mass.

34. A method of recovering liquid and gaseous products from an in situ oil shale retort in a subterranean formation containing oil shale, such an in situ oil shale retort containing a fragmented permeable mass of particles containing oil shale, said fragmented mass having top, bottom and side boundaries, comprising the steps of:

excavating a first portion of the formation to form a base of operation at a level in the formation above the top boundary of the fragmented mass being formed, and leaving unfragmented formation extending from the floor of the base of operation to the roof of the base of operation as roof supporting pillars within the boundaries of the base of operation, the horizontal extent of the base of operation being sufficient to provide effective access to substantially the entire horizontal cross section of the fragmented mass being formed;

excavating a second portion of the formation from within the boundaries of the fragmented mass being formed to form a vertically extending slot, the surfaces of the formation defining the slot providing parallel free faces extending vertically through the formation within the boundaries of the fragmented mass being formed, and leaving a third portion of the formation, which is to be fragmented by expansion toward the slot within the boundaries of the fragmented mass being formed and extending away from such free faces, and wherein the top of the slot is spaced below the bottom of the base of operation, leaving unfragmented formation as a horizontal sill pillar between the top of the slot and the bottom of the base of operation, the vertical thickness of the horizontal sill pillar being sufficient that the horizontal sill pillar remains unfragmented after explosive expansion of said third portion toward the slot, at least one of such roof supporting pillars in the base of operation being on each side of the slot;

detonating explosive on each side of the slot for explosively expanding said third portion of formation toward the slot from both sides of the slot for fragmenting said third portion of formation and at least partially isolating a portion of the sill pillar and such a roof supporting pillar on one side of the slot from blasting stresses from the opposite sides of the slot to avoid fragmenting the horizontal sill pillar or such roof supporting pillar and provide a safe base of operation above the top boundary of the fragmented mass for effective access to substantially the entire horizontal cross section of the fragmented mass;

establishing a combustion zone in an upper portion of the fragmented mass below the horizontal sill pillar, the combustion zone having a temperature higher than an ignition temperature of oil shale;

introducing an oxygen containing gas to the fragmented mass through the horizontal sill pillar for sustaining the combustion zone and advancing the combustion zone through the fragmented mass;

withdrawing an off gas from a lower portion of the fragmented mass whereby gas flow on the advancing side of the combustion zone establishes a retorting zone and advances the retorting zone through the fragmented mass, thereby retorting oil shale in the fragmented mass and producing liquid and gaseous products, said gaseous products being withdrawn in the off gas; and withdrawing such liquid products from a lower portion of the fragmented mass.

35. A method of forming, in a subterranean formation containing oil shale, an in situ oil shale retort containing a fragmented permeable mass of particles containing oil shale, said fragmented mass having top, bottom and side boundaries, comprising the steps of:

excavating a first portion of the formation to form a base of operation at an elevation in the formation above the top boundary of the fragmented mass being formed, and leaving unfragmented formation extending from the floor of the base of operation of the roof of the base of operation as at least one roof supporting pillar within the boundaries of the base of operation, the largest span between roof supporting pillars being sufficient small to prevent tensile scabbing of the floor of the base of operation due to short term loads imposed by explosive expansion to form the fragmented mass in the retort;

excavating a means for access through the formation to a location underlying the base of operation;

excavating a second portion of the formation from within the boundaries of the fragmented mass being formed to form at least one vertically extending void, the surface of the formation defining such a void providing at least one free face extending vertically through the formation within the boundaries of the fragmented mass being formed, and leaving a third portion of the formation, which is to be fragmented by expansion toward such a void, within the boundaries of the fragmented mass being formed and extending away from such a free face, and wherein such void extends vertically between the means for access and an elevation space below the bottom of the base of operation, leaving a horizontal sill pillar of intact formation between the top of the void and the bottom of the base of operation, the vertical thickness of the horizontal sill pillar being sufficient to maintain a safe base of operation after explosive expansion of said third portion toward such a void; and explosively expanding said third portion of formation toward such a void with a single round of explosions for fragmenting said third portion of formation without fragmenting the horizontal sill pillar, or such a roof supporting pillar, thereby providing a safe base of operation above the top boundary of the fragmented mass having a sufficient horizontal extent to provide effective access to substantially the entire horizontal cross section of the fragmented mass.

36. A method of forming, in a subterranean formation containing oil shale, an in situ oil shale retort containing a fragmented permeable mass of particles containing oil shale, said fragmented mass having top, bottom and side boundaries, comprising the steps of:

excavating a portion of the formation to form a base of operation at an upper elevation in the formation above the top boundary of the fragmented mass being formed, and leaving unfragmented formation extending from the floor of the base of operation to the roof of the base of operation as at least one roof supporting pillar within the boundaries of the base of operation, such a roof supporting pillar having adequate strength to withstand short term loads imposed by explosive expansion to form the fragmented mass in the retort; and forming a fragmented permeable mass of formation particles with a top boundary at an elevation a sufficient distance below the base of operation to leave a horizontal sill pillar of unfragmented formation below the bottom of the base of operation and the top boundary of the fragmented mass for maintaining a safe base of operation, the fragmented mass having side boundaries located beneath the base of operation so as to provide effective access to essentially the entire horizontal cross section of the fragmented mass from the base of operation.

37. A method of forming an in situ oil shale retort in a subterranean formation containing oil shale, the in situ oil shale retort containing a fragmented permeable mass of formation particles containing oil shale, said fragmented mass having top, bottom and side boundaries, comprising the steps of:

excavating a first portion of the formation to form a base of operation at an elevation in the formation above the top boundary of the fragmented mass being formed, and leaving unfragmented formation extending from the floor of the base of operation to the roof of the base of operation as roof supporting pillars within the boundaries of the base of operation, the largest span between roof supporting pillars being sufficiently small to prevent tensile scabbing of the floor of the base of operation, due to short term loads imposed by explosive expansion to form the fragmented mass in the retort;

excavating a second portion of the formation from within the boundaries of the fragmented mass being formed to form at least one slot, the surface of the formation defining the walls of such a slot providing a pair of parallel free faces extending vertically through the formation within the boundaries of the fragmented mass being formed, the top of the slot being spaced below the bottom of the base of operation to leave intact formation therebetween; and explosively expanding a third portion of the formation remaining within the boundaries of the fragmented mass being formed and extending horizontally from said free faces toward such a slot for forming a fragmented permeable mass of formation particles without fragmenting formation between the elevation of the top of the slot and the bottom of the base of operation nor fragmenting such roof supporting pillars for leaving a horizontal sill pillar of unfragmented formation between the top boundary of the fragmented mass and the bottom of the base of operation for maintaining a safe base of operation after forming the fragmented mass.

38. A method of forming an in situ oil shale retort in a subterranean formation containing oil shale, the in situ oil shale retort containing a fragmented permeable mass of formation particles containing oil shale, said fragmented mass having top, bottom and side boundaries, comprising the steps of:

excavating a first portion of the formation to form a base of operation at an elevation in the formation above the top boundary of the fragmented mass being formed, and leaving unfragmented formation extending from the floor of the base of operation to the roof of the base of operation as at least one roof supporting pillar within the boundaries of the base of operation, such a roof supporting pillar having adequate strength to withstand short term loads imposed by explosive expansion to form the fragmented mass in the retort;

excavating a second portion of the formation from within the boundaries of the fragmented mass being formed to form at least one slot, the surface of the formation defining the walls of such a slot providing a pair of parallel free faces extending vertically through the formation within the boundaries of the fragmented mass being formed, the top of the slot being spaced below the bottom of the base of operation to leave intact formation therebetween; and explosively expanding a third portion of the formation remaining within the boundaries of the fragmented mass being formed and extending horizontally from said free faces toward such a slot for forming a fragmented permeable mass of formation particles without fragmenting formation between the elevation of the top of the slot and the bottom of the base of operation nor fragmenting such a roof supporting pillar for leaving a horizontal sill pillar of unfragmented formation between the top boundary of the fragmented mass and the bottom of the base of operation for maintaining a safe base of operation after forming the fragmented mass.

* * * * *